US008622384B2

(12) United States Patent
Nireki

(10) Patent No.: US 8,622,384 B2
(45) Date of Patent: Jan. 7, 2014

(54) PAPER SHEET PROCESSING DEVICE

(75) Inventor: Takao Nireki, Tokyo (JP)

(73) Assignee: Universal Entertainment Corp., Tokyo (JP)

( * ) Notice: Subject to any disclaimer, the term of this patent is extended or adjusted under 35 U.S.C. 154(b) by 230 days.

(21) Appl. No.: 12/747,443

(22) PCT Filed: Dec. 9, 2008

(86) PCT No.: PCT/JP2008/072349

§ 371 (c)(1),
(2), (4) Date: Jun. 10, 2010

(87) PCT Pub. No.: WO2009/075270

PCT Pub. Date: Jun. 18, 2009

(65) Prior Publication Data

US 2011/0049796 A1 Mar. 3, 2011

(30) Foreign Application Priority Data

Dec. 10, 2007 (JP) ..... 2007-318065

(51) Int. Cl.
*B65H 29/38* (2006.01)

(52) U.S. Cl.
USPC ..... 271/177

(58) Field of Classification Search
USPC ..... 194/203, 350, 202, 351, 302, 206; 414/789.9; 271/177, 178, 180, 181, 271/265.01, 258.01, 145; 324/207.11, 324/207.13
See application file for complete search history.

(56) References Cited

U.S. PATENT DOCUMENTS

| | | | | |
|---|---|---|---|---|
| 3,286,161 | A * | 11/1966 | Jones et al. | 323/353 |
| 4,816,652 | A * | 3/1989 | Wildgoose et al. | 235/379 |
| 6,375,185 | B1 * | 4/2002 | Lin | 271/177 |
| 6,877,599 | B2 * | 4/2005 | Pai | 194/203 |
| 2009/0107798 | A1 * | 4/2009 | Nireki | 194/206 |

FOREIGN PATENT DOCUMENTS

| | | |
|---|---|---|
| JP | 55 159473 | 11/1980 |
| JP | 55-159473 U | 11/1980 |
| JP | 5 79679 | 10/1993 |

OTHER PUBLICATIONS

Notification of First Office Action for Chinese Patent Application 200880119901.5 issued Mar. 29, 2012.
Office Action for Australian Patent Application No. 2008336640 issued Oct. 8, 2012.

* cited by examiner

*Primary Examiner* — Thomas Morrison
(74) *Attorney, Agent, or Firm* — KMF Patent Services, PLLC; S. Peter Konzel; Kenneth M. Fagin

(57) ABSTRACT

A paper sheet processing apparatus that can detect in an inexpensive way that a bill housing part is full with bills. The paper sheet processing apparatus includes: a bill housing part that houses a bill in a stacked manner; a placing plate arranged in the bill housing part and moves as a bill is stacked and housed; a magnetic body magnetized and disposed on the placing plate; a magnetic sensor that detects an amount of magnetism from the magnetic body; and a control part that determines whether the amount of magnetism detected by the magnetic sensor is greater than or equal to a threshold value.

8 Claims, 21 Drawing Sheets

PAPER SHEET PROCESSING DEVICE

FIELD OF THE INVENTION

The present invention relates to a paper sheet processing apparatus (or paper sheet processing device) comprising a paper sheet housing part housing bills, cards, coupon tickets, and so on (hereafter collectively referred to as "paper sheets") and detection means detecting that the paper sheet housing part has become full with the paper sheets.

BACKGROUND ART

In general, a bill processing apparatus, which is one of the embodiments of the paper sheet processing apparatus, is incorporated into a service device such as a game medium rental machine installed in a game hall, a vending machine or a ticket-vending machine installed in a public space, or the like which identifies the validity of a bill inserted from a bill insertion slot by a user and provides various types of products and services in accordance with a value of the bill having been judged as valid.

Such a bill processing apparatus usually comprises a bill conveyance mechanism that conveys a bill inserted into the bill insertion slot, a bill identification part that conducts validity judgment (also referred to as "authenticity judgment") whether the bill to be conveyed is valid or not, and a bill housing part (bill housing stacker) housing one bill after another having been validated by the bill identification part. This bill housing part also has a function as a safe, which is configured attachable to and removable from the apparatus main body, and comprises a placing plate, on which a plurality of bills are stacked and housed, pressing means (presser spring) for biasing the placing plate, and a presser plate for pressing a bill onto the placing plate against a biasing force by the presser spring such that the bill is guided and positioned thereon.

When the bill is guided between the placing plate and the presser plate, the presser plate is driven from an initial position to a pressing position on the placing plate side and presses bills onto the placing plate in the pressing position. The, as the presser plate is driven to return to the initial position, the bills having been pressed onto the placing plate are pushed back by the biasing force of the presser spring so that the uppermost bill of the bills hits and contacts a regulatory part whereby a plurality of bills are stacked and housed one after another on the placing plate.

Here, it is likely that the above-described bill housing part may fail in operation if too many bills are guided thereto such that detection means detecting that the number of bills on the placing plate reaches capacity limit is provided as disclosed in Patent Document 1. The detection means disclosed in Patent Document 1 detects a full state with the bills when a swinging lever is turned as bills are placed on a receiving plate (placing plate) inside a cassette in which the swinging lever has been rotatably installed. That is, the receiving plate is enabled to contact one end of the swinging lever when the full state with bills is reached, a slide lever engaged with the other end is raised by a lever action upon contacting the receiving plate, and the rising of the slide lever is detected by an optical sensor, having a light emitting part and alight receiving part, or a micro switch, etc., to detect that the receiving plate has become full with bills.

[Patent Document 1] Japanese unexamined utility model application publication No. H05-79679

DISCLOSURE OF THE INVENTION

Problem to be Solved by the Invention

In the above-described bill processing apparatus, since the full state with bills in the bill housing part is detected by detecting, via the swinging lever and the slide lever, a depressed position of the receiving plate on which the bills are placed, the number of parts may increase and cause inflation of manufacturing cost.

In the present invention, a paper sheet processing apparatus capable of inexpensively detecting that a paper sheet housing part has become full with paper sheets is provided.

Means to Solve the Problem

In the present invention, a paper sheet processing apparatus comprises a paper sheet housing part, in which paper sheets are stacked and housed, a placing plate, which is installed inside the paper sheet housing part and moves as more paper sheets are stacked and housed, a magnetic body being magnetized, which is installed on the placing plate, a magnetic sensor, which detects a magnetism amount of the magnetic body, and determination means, which determines whether or not the magnetism amount detected by the magnetic sensor is equal to or greater than a threshold value. Further features of the present invention, its nature, and various advantages will be more apparent from the accompanying drawings and the following description of the preferred embodiment.

DESCRIPTION OF NOTATIONS

Figure 1:
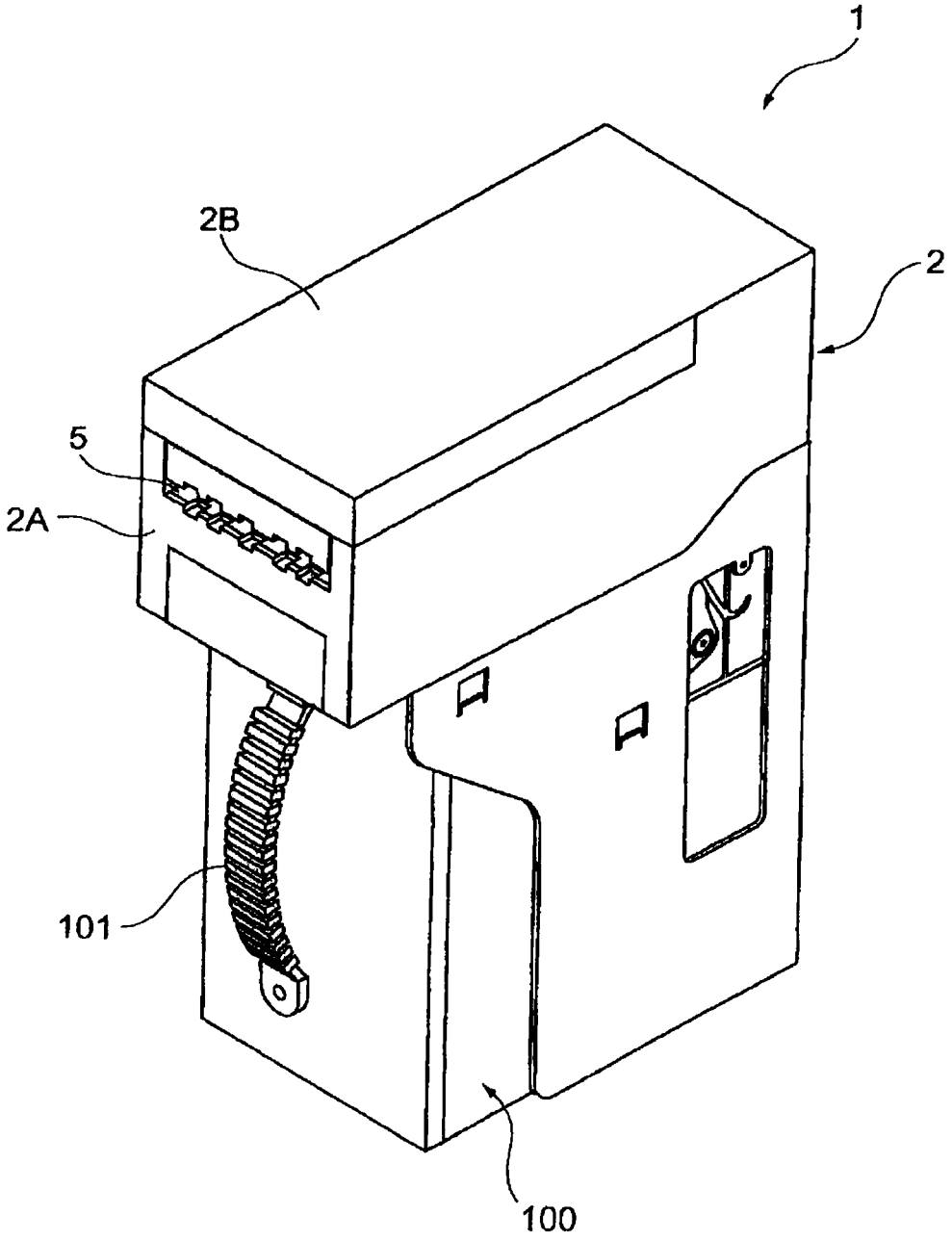
FIG. 1 is a perspective view showing an entire structure to illustrate a configuration of a bill processing apparatus of this embodiment.

1 bill processing apparatus
2 apparatus main body
2A frame
3 bill traveling route
5 bill insertion slot
6 bill conveyance mechanism
8 bill reading means
10 skew correction mechanism
100 bill housing part
105 placing plate
108 press standby part
115 presser plate
120 presser plate driving mechanism
140 magnetic sensor
140A magnet
140F shield body
200 control means

BEST MODE FOR CARRYING OUT THE INVENTION

Figure 2:
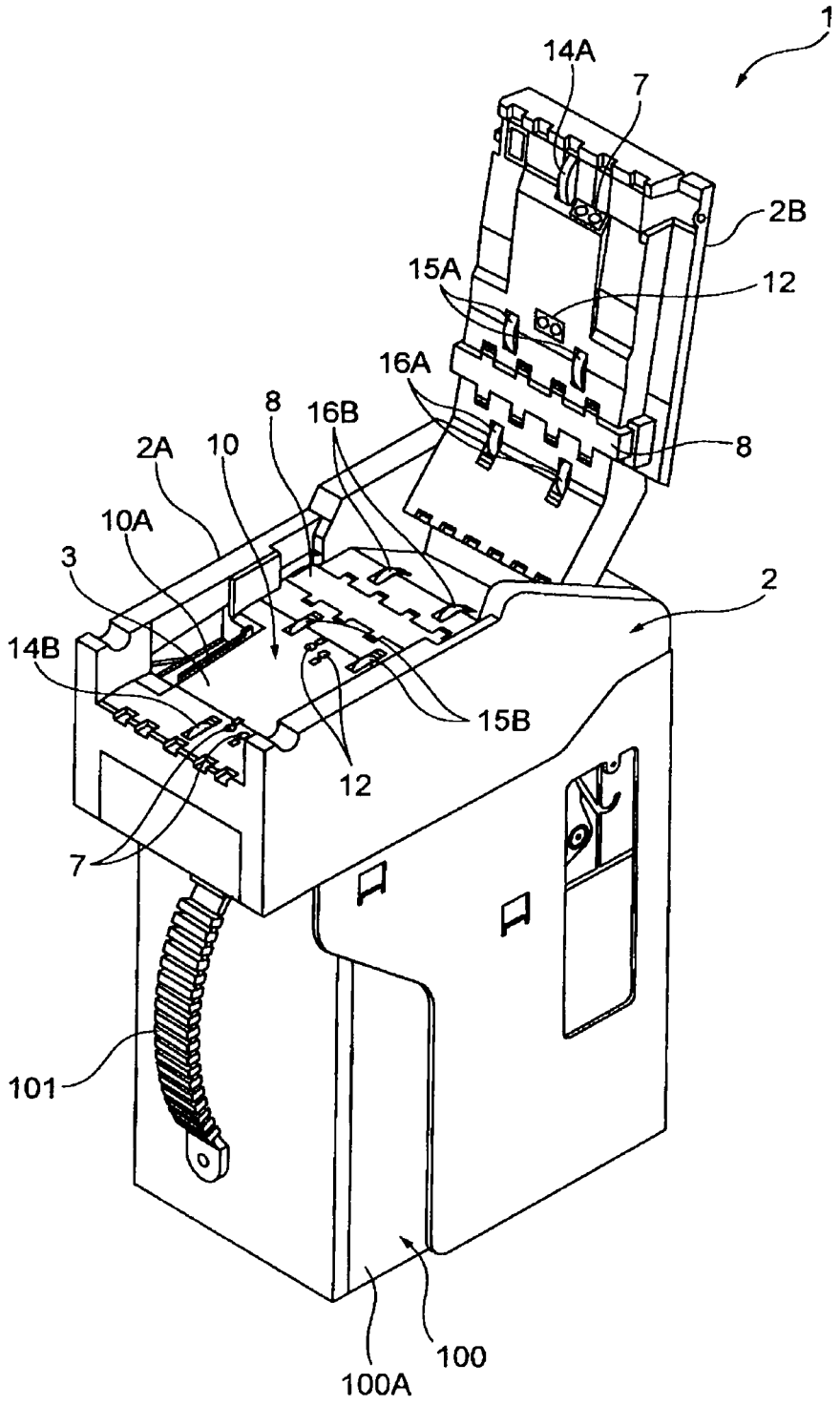
FIG. 2 is a perspective view showing the bill processing apparatus in a state that an open/close member is opened for a main body frame of an apparatus main body.
Figure 3:
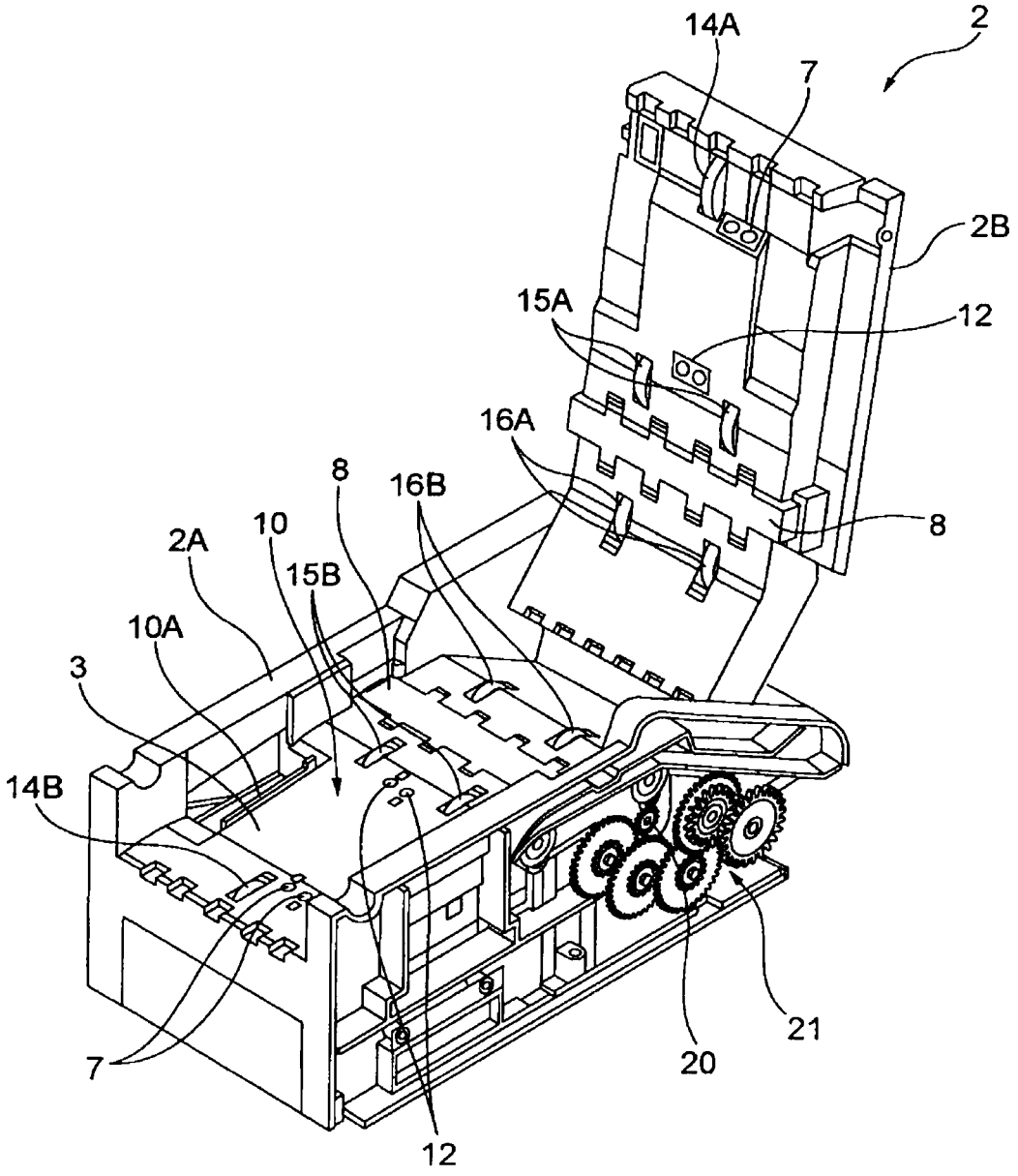
FIG. 3 is a perspective view showing a configuration of a power transmission part of the apparatus main body.
Figure 4:
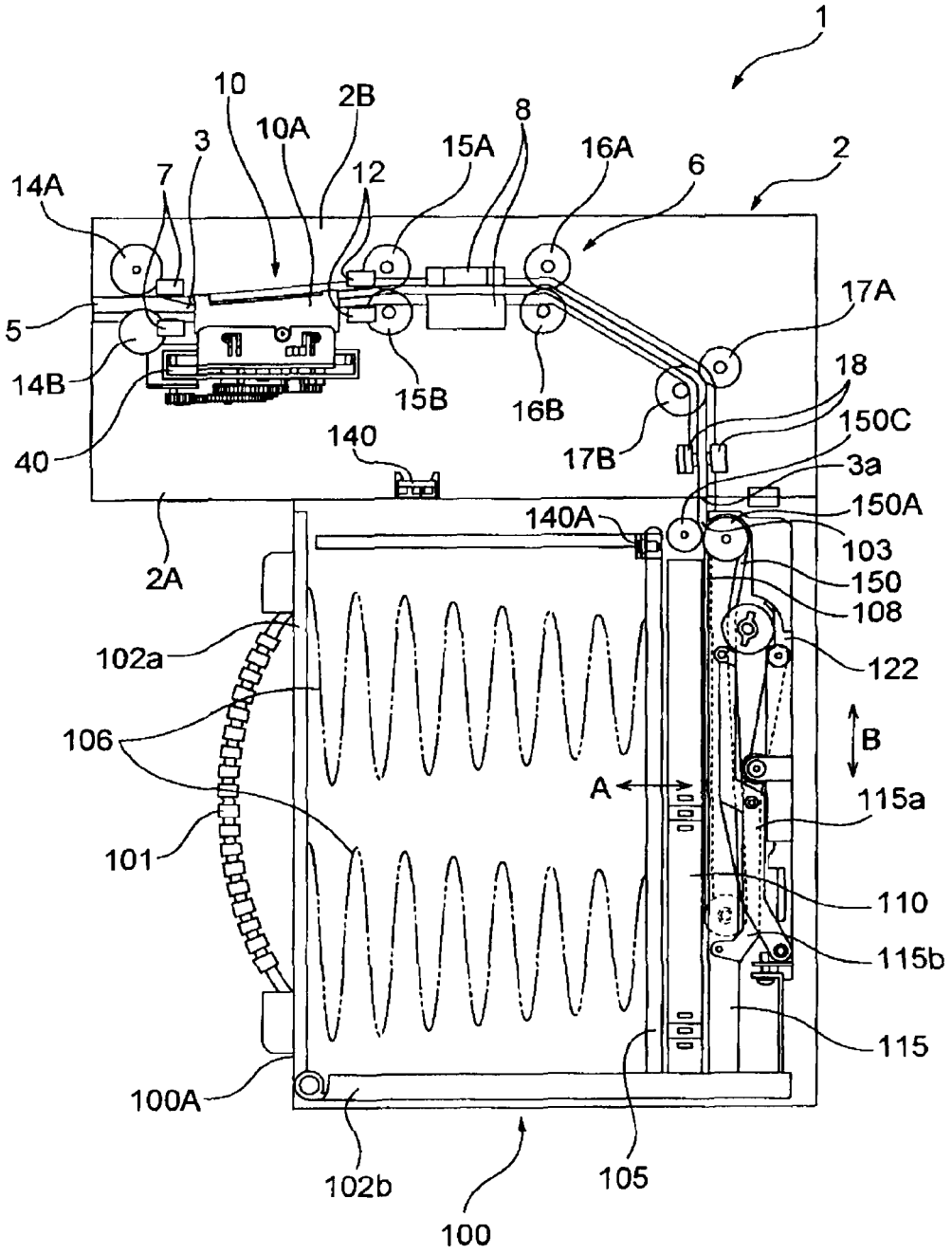
FIG. 4 is a right side view schematically showing a traveling route of a bill to be inserted from an insertion slot.
Figure 5:
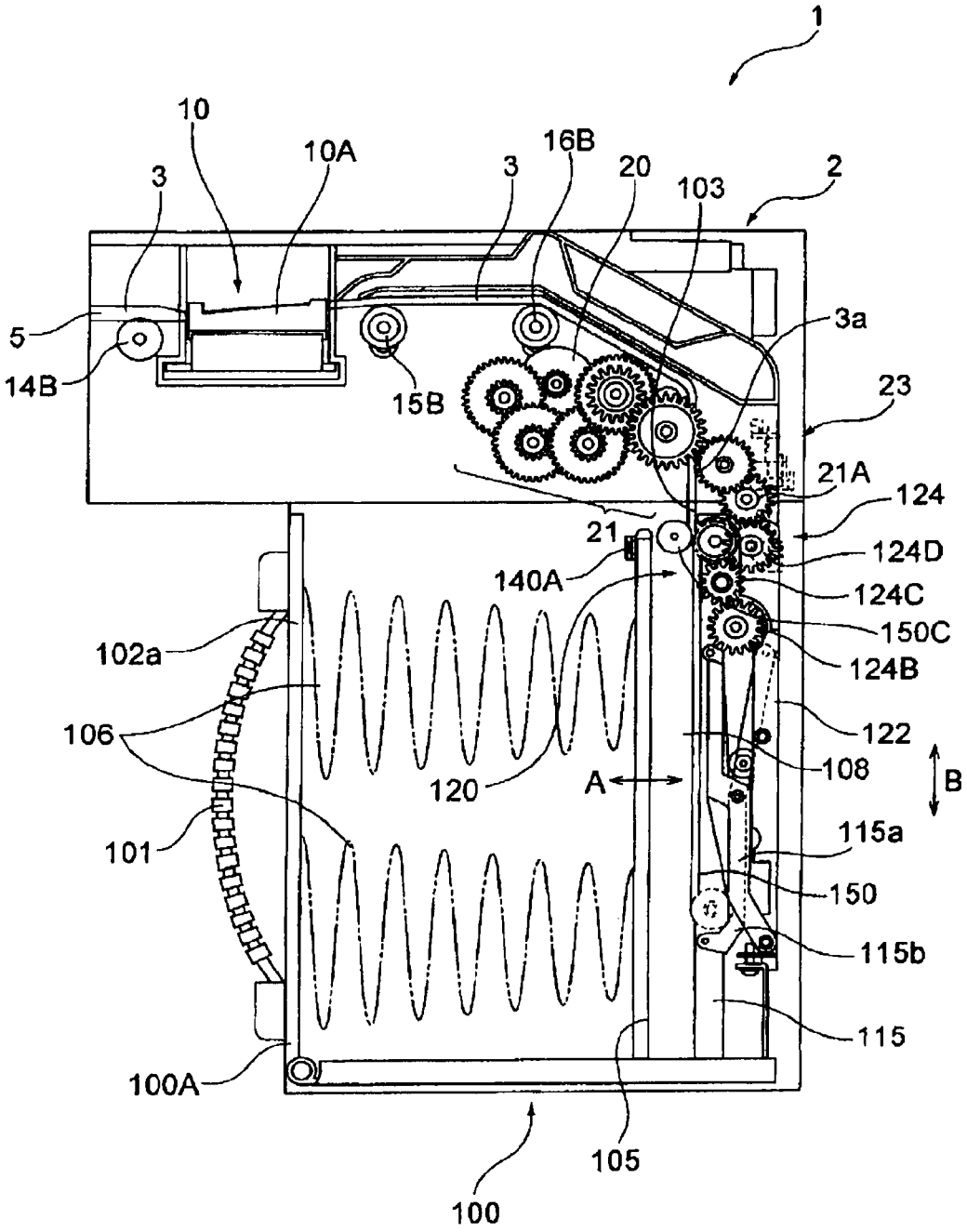
FIG. 5 is a view showing a schematic configuration of a power transmission mechanism for driving the presser plate arranged in a bill housing part.
Figure 6:
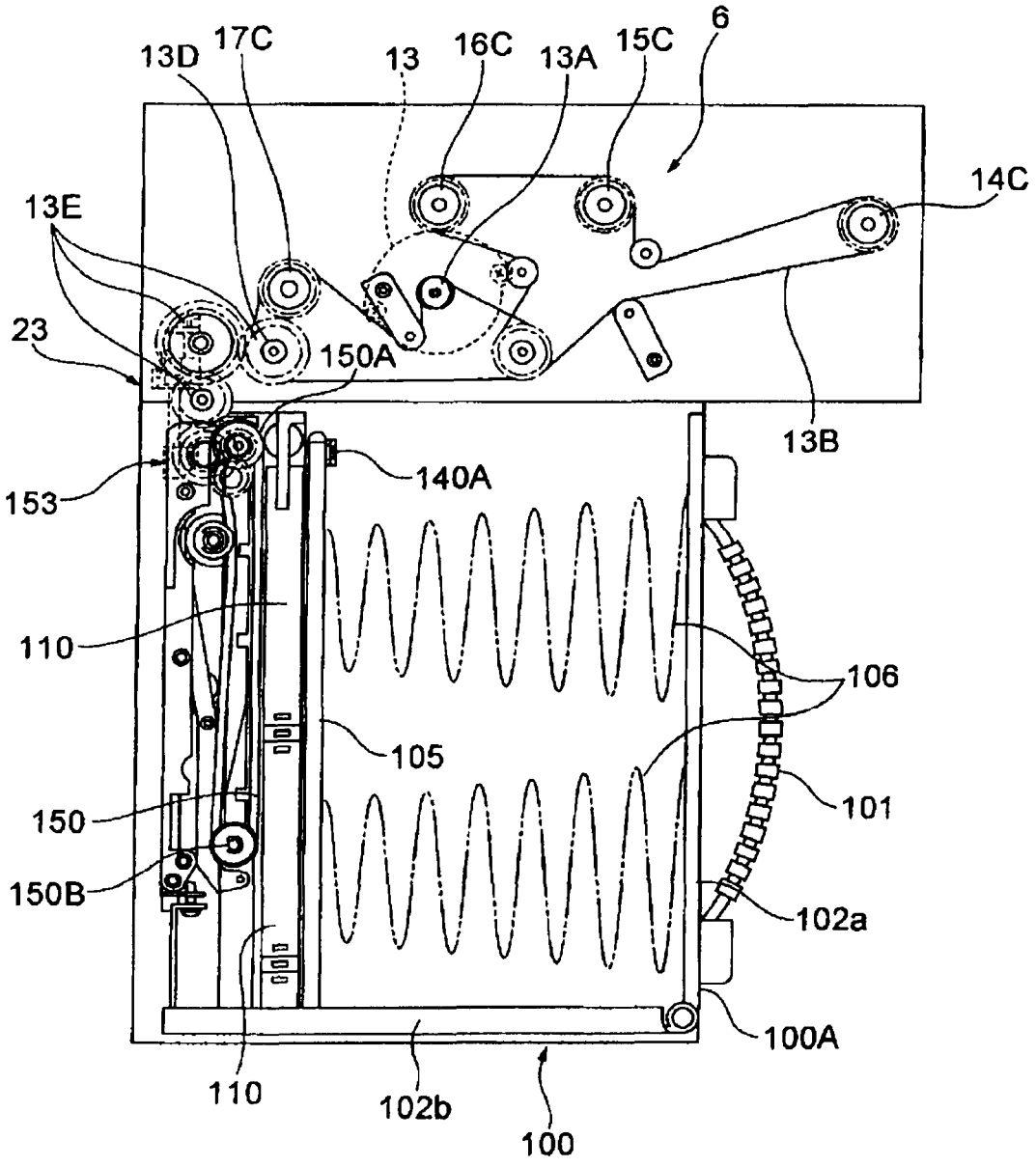
FIG. 6 is a left side view showing a schematic configuration of a driving source and a driving force transmission mechanism to drive a bill conveyance mechanism.
Figure 7:
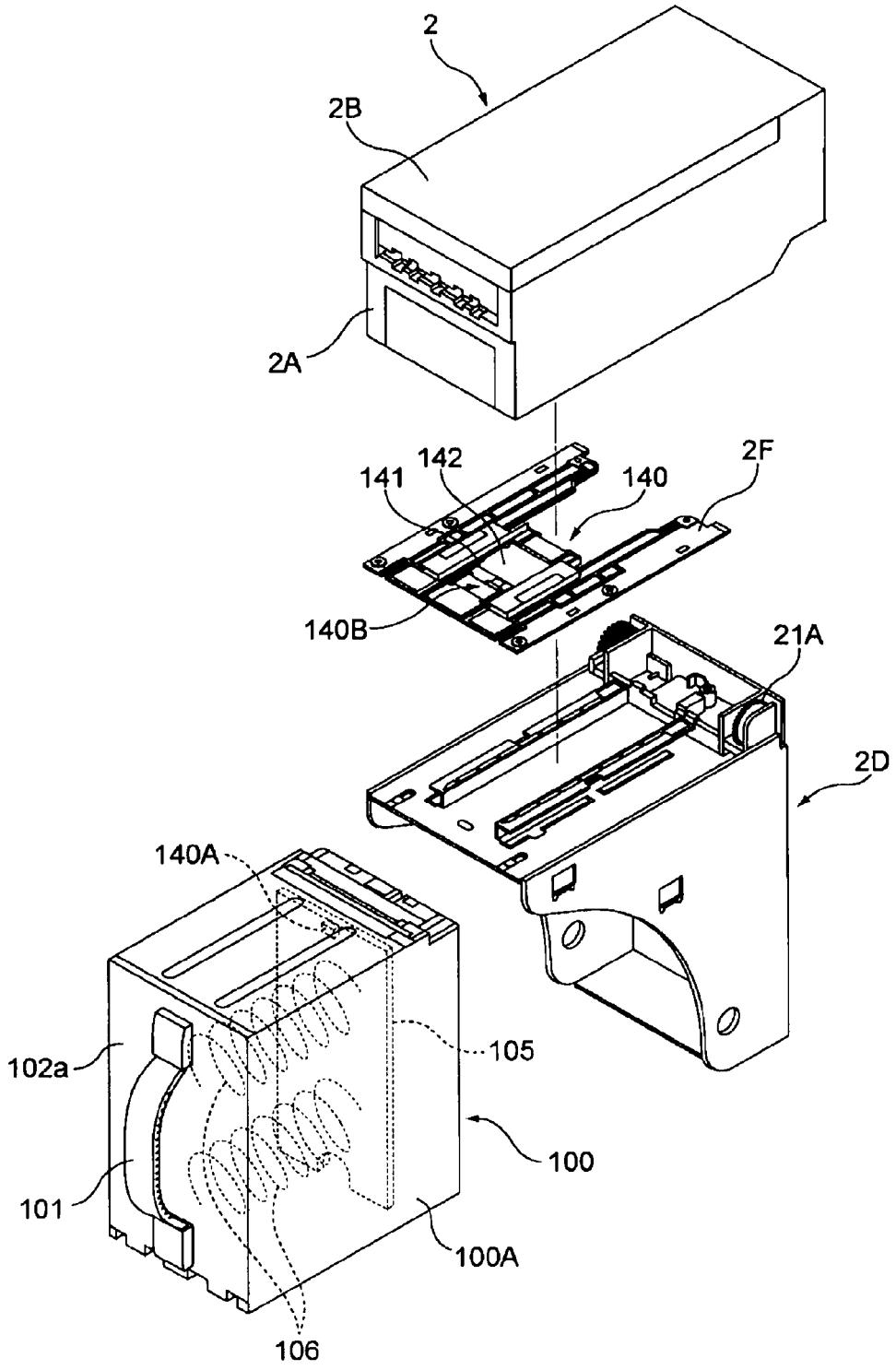
FIG. 7 is an exploded perspective view showing a bill processing apparatus.

FIGS. 1 to 7 are diagrams showing a bill processing apparatus of a paper sheet processing apparatus as one of the embodiments according to the present invention. FIG. 1 is a perspective view showing a general configuration thereof, FIG. 2 is a perspective view showing a state that an open/close member is opened for a main body frame of an apparatus main body, FIG. 3 is a perspective view showing a configuration of a power transmission part of the apparatus main body, FIG. 4 is a right side view schematically showing a traveling route of a bill inserted from an insertion slot, FIG. 5 is a view showing a schematic configuration of a power transmission mechanism to drive a presser plate disposed in a bill housing part, FIG. 6 is a left side view showing a schematic configuration of a driving source and a driving force transmission mechanism to drive a bill conveyance mechanism, and FIG. 7 is an exploded perspective view showing a bill processing apparatus.

A bill processing apparatus 1 of this embodiment is configured to be incorporable into, for example, various types of gaming machines such as slot machines, and the bill processing apparatus 1 includes an apparatus main body 2 and a bill housing part (bill stacker) 100 which is provided on the apparatus main body 2 and is capable of stacking and housing a great number of bills. The bill housing part 100 has a function as a safe and is configured to be mountable to and demountable from a frame 2A constituting the apparatus main body 2. In this embodiment, for example, it is possible to remove the bill housing part 100 from the frame 2A of the apparatus main body 2 by pulling a handle 101 fixed to a front face thereof in a state that a lock mechanism (not shown) is unlocked.

Here, as shown in FIG. 7, the above-described bill processing apparatus 1 is mainly constituted of three structural bodies. That is, the bill processing apparatus 1 comprises the apparatus main body 2, a stand (frame member) 2D, in which the apparatus main body 2 is placed in a mountable/demountable manner, and a bill housing part 100, installed into the stand 2D in a mountable/demountable manner. Here, a plate 2F that has installed thereon a sensor board 141 on which a magnetic sensor 140 to be described later and a reader/writer 142 are implemented is in turn installed onto a rear surface side of the apparatus main body 2 as a unit wherein the reader/writer 142 writes and reads information into and from a storage part (for example, an IC tag disposed in the bill housing part) in which bill information is written. The plate 2F is interposed between the frame 2A, constituting the apparatus main body, and a top surface of the stand 2D and is fixed between these components.

As shown in FIGS. 2 and 3, the apparatus main body 2 has the frame 2A and an open/close member 2B configured to be opened and closed with its one end as a rotating center with respect to the frame 2A. Then, as shown in FIG. 4, the frame 2A and the open/close member 2B are configured to form a space (bill traveling route) 3 through which a bill is carried such that both frame and member face with each other across the space when the open/close member 2B is closed for the frame 2A, and to form a bill insertion slot 5 such that front exposed faces of both frame and member are aligned and that the bill traveling route 3 exits at the bill insertion slot 5. In addition, the bill insertion slot 5 is a slit-like opening from which a short side of a bill can be inserted into the inside of the apparatus main body 2.

In the apparatus main body 2, a bill conveyance mechanism 6 that conveys a bill; an insertion detecting sensor 7 that detects the bill inserted into the bill insertion slot 5; bill reading means 8 that is installed on a downstream side of the insertion detecting sensor 7 and reads information from the bill in a travelling state; a skew correction mechanism 10 that accurately positions and conveys the bill with respect to the bill reading means 8; a movable piece passage detecting sensor that detects that the bill passes through movable pieces constituting the skew correction mechanism 10; a discharge detecting sensor 18 that detects that the bill is discharged into the bill housing part 100; a presser plate detecting sensor 23 for detecting a position of a presser plate 115 pressing the bill toward a placing plate 105 in the bill housing part 100; a sensor (magnetic sensor 140) for detecting whether bills stacked and housed in the bill housing part 100 are in a predetermined state or not; and control means 200 (a control circuit board 200A; refer to FIG. 15) for controlling the driving of the bill conveyance mechanism 6, the bill reading means 8, the skew correction mechanism 10, and so on are provided.

Hereafter, the respective components described above will be described in detail. The bill traveling route 3 is extended from the bill insertion slot 5 toward the back side, and is formed to be bent so as to be inclined downward at its rear side, and to be eventually bent in the vertical direction. A discharge slot 3*a* from which the bill is discharged into the bill housing part 100 is formed in the bill traveling route 3, and the bill discharged therefrom is fed into a feed port (receiving port) 103 of the bill housing part 100 in the vertical direction.

The bill conveyance mechanism 6 is a mechanism capable of conveying a bill inserted from the bill insertion slot 5 along the inserting direction, and of conveying back the bill in an insertion state toward the bill insertion slot 5. The bill conveyance mechanism 6 comprises a motor 13 (refer to FIG. 6) serving as a driving source installed in the apparatus main body 2; and conveyor roller pairs (14A and 14B), (15A and 15B), (16A and 16B), and (17A and 17B) which are installed at predetermined intervals along the bill traveling direction in the bill traveling route 3, and are driven to rotate by the motor 13.

The conveyor roller pairs are installed so as to be partially exposed on the bill traveling route 3, and all the pairs are constituted of driving rollers of the conveyor rollers 14B, 15B, 16B, and 17B installed on the underside of the bill traveling route 3 driven by the motor 13; and pinch-rollers of the conveyor rollers 14A, 15A, 16A, and 17A installed on the upperside and driven by the these driving rollers. In addition, the conveyor roller pair (14A and 14B) to first nip and hold therebetween the bill inserted from the bill insertion slot 5, and to carry the bill toward the back side, as shown in FIGS. 2 and 3, is installed in one portion of the center position of the bill traveling route 3, and a couple of the conveyor roller pairs (15A and 15B), (16A and 16B), or (17A and 17B) being disposed in this order on the downstream side thereof are respectively installed in a couple of portions with a predetermined interval in the lateral direction of the bill traveling route 3.

Further, the conveyor roller pair (14A and 14B) disposed in the vicinity of the bill insertion slot 5 is usually in a state that the upper conveyor roller 14A is spaced from the lower conveyor roller 14B, and the upper conveyor roller 14A is driven to move toward the lower conveyor roller 14B to nip and hold the inserted bill therebetween when insertion of the bill is sensed by the insertion detecting sensor 7. In addition, the upper conveyor roller 14A is controllably driven to be pressed against or spaced from the conveyor roller 14B by a driving source 70 (refer to a block diagram of FIG. 15). The driving source 70 may comprise a motor, solenoid, and the like, and is installed in the open/close member 2B.

Then, the upper conveyor roller 14A is spaced from the lower conveyor roller 14B so as to release the load on the bill when a process (skew correction process) for positioning the bill for the bill reading means 8 by eliminating tilt of the inserted bill is executed by the skew correction mechanism 10, and the upper conveyor roller 14A is driven to move toward the lower conveyor roller 14B again to nip and hold the bill therebetween when the skew correction process is completed. The skew correction mechanism 10 comprises a pair of right and left movable pieces 10A (only one side is shown) that perform skew correction and the skew correction process is performed by driving a motor 40 for a skew driving mechanism.

The conveyor rollers 14B, 15B, 16B and 17B installed on the underside of the bill traveling route 3 are, as shown in FIG. 6, driven to rotate via the motor 13 and pulleys 14C, 15C, 16C, and 17C installed at the ends of the driving shafts of the respective conveyor rollers. That is, a driving pulley 13A is installed on the output shaft of the motor 13, and a driving belt 13B is wrapped around between the pulleys 14C, 15C, 16C, and 17C installed at the ends of the driving shafts of the respective conveyor rollers and the driving pulley 13A. In addition, tension pulleys are engaged in places with the driving belt 13B, which prevents the driving belt 13B from loosening.

In accordance with the configuration described above, when the motor 13 is driven to normally rotate, the conveyor rollers 14B, 15B, 16B, and 17B are driven to normally rotate in synchronization therewith to carry the bill toward the insertion direction. When the motor 13 is driven to reversely rotate, the conveyor rollers 14B, 15B, 16B, and 17B are driven to reversely rotate in synchronization therewith to carry back the bill toward the bill insertion slot 5 side.

The insertion detecting sensor 7 is to generate a detection signal when a bill inserted into the bill insertion slot 5 is detected. In this embodiment, the insertion detecting sensor 7 is installed between the pair of conveyor rollers (14A and 14B) and the skew correction mechanism 10. The insertion detecting sensor 7 comprises, for example, an optical sensor such as a regressive reflection type photo sensor. However, the insertion detecting sensor 7 may comprise a mechanical sensor other than the optical sensor.

Further, the movable piece passage detecting sensor 12 is to generate a sensed signal when it is sensed that a front end of the bill passes through a pair of right and left movable pieces 10A constituting the skew correction mechanism 10, and the movable piece passage detecting sensor 12 is installed on the upstream side of the bill reading means 8. The movable piece passage detecting sensor 12 also comprises an optical sensor or a mechanical sensor in the same way as mentioned before with respect to the insertion detecting sensor.

Further, the discharge detecting sensor 18 is to detect a trailing end of the bill passing through such that it is detected that the bill is discharged into the bill housing part 100. The discharge detecting sensor 18 is disposed just in front of the receiving port 103 of the bill housing part 100 on the downstream side of the bill traveling route 3. The discharge detecting sensor 18 also comprises an optical sensor or a mechanical sensor in the same way as the aforementioned insertion detecting sensor.

The bill reading means 8 reads bill information on the bill carried in a state that the skew is eliminated by the skew correction mechanism 10 (in a state that the bill is accurately positioned), and judges whether the bill is true or false. In detail, for example, the bill reading means 8 may comprise a line sensor that performs reading of the bill such that a bill to be carried is irradiated with light from upper and lower sides, and transmitted light therethrough and reflected light therefrom are detected by a light receiving element. A line sensor is shown in the drawing, and an optical signal read by the line sensor is photoelectric-converted, and the signal is compared and checked with data of a legitimate bill stored in advance, which makes it possible to identify the authenticity of the bill to be carried.

The bill housing part 100 stacks and houses bills one after another after the bills are identified as being legitimate by the bill reading means 8. Here, the configuration of the bill housing part 100 will be described with reference to FIGS. 8 to 14 in addition to FIGS. 4 to 7.

Figure 8:
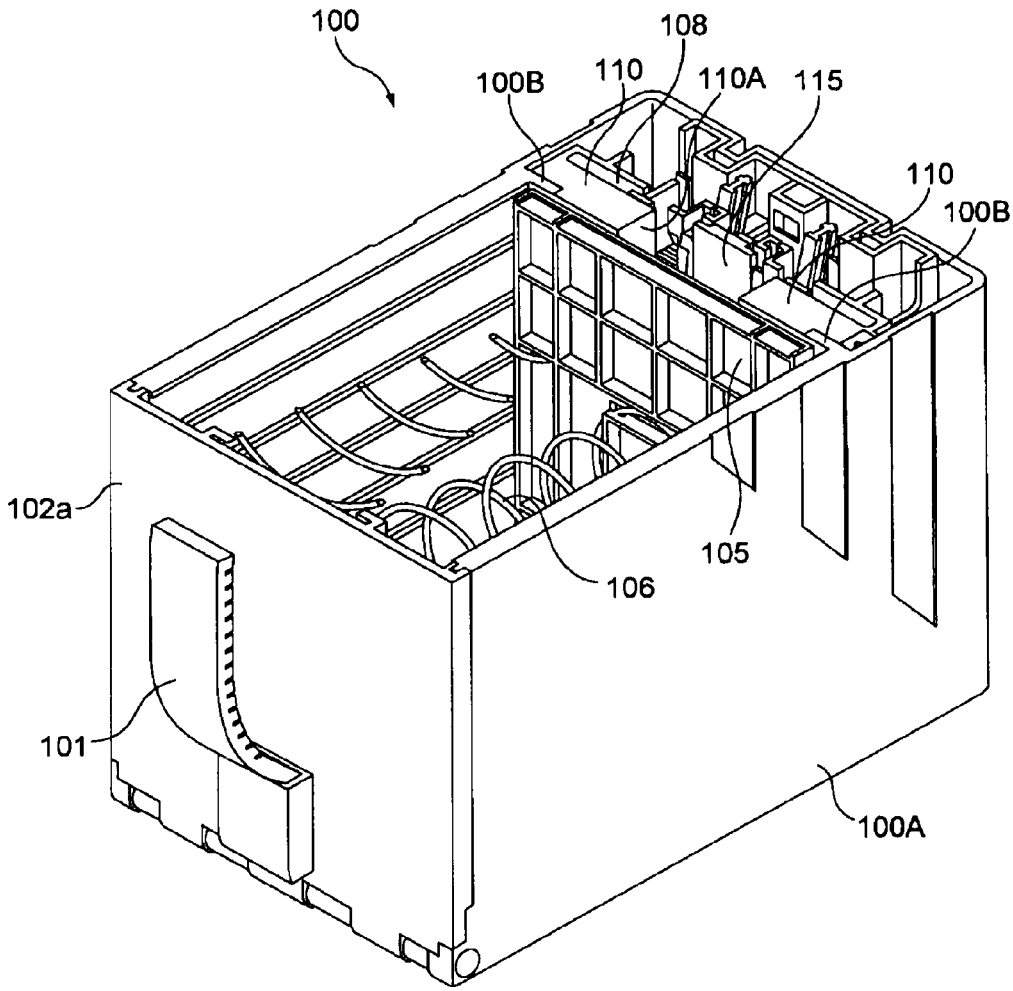
FIG. 8 is a perspective view showing an interior configuration of the bill housing part.
Figure 9:
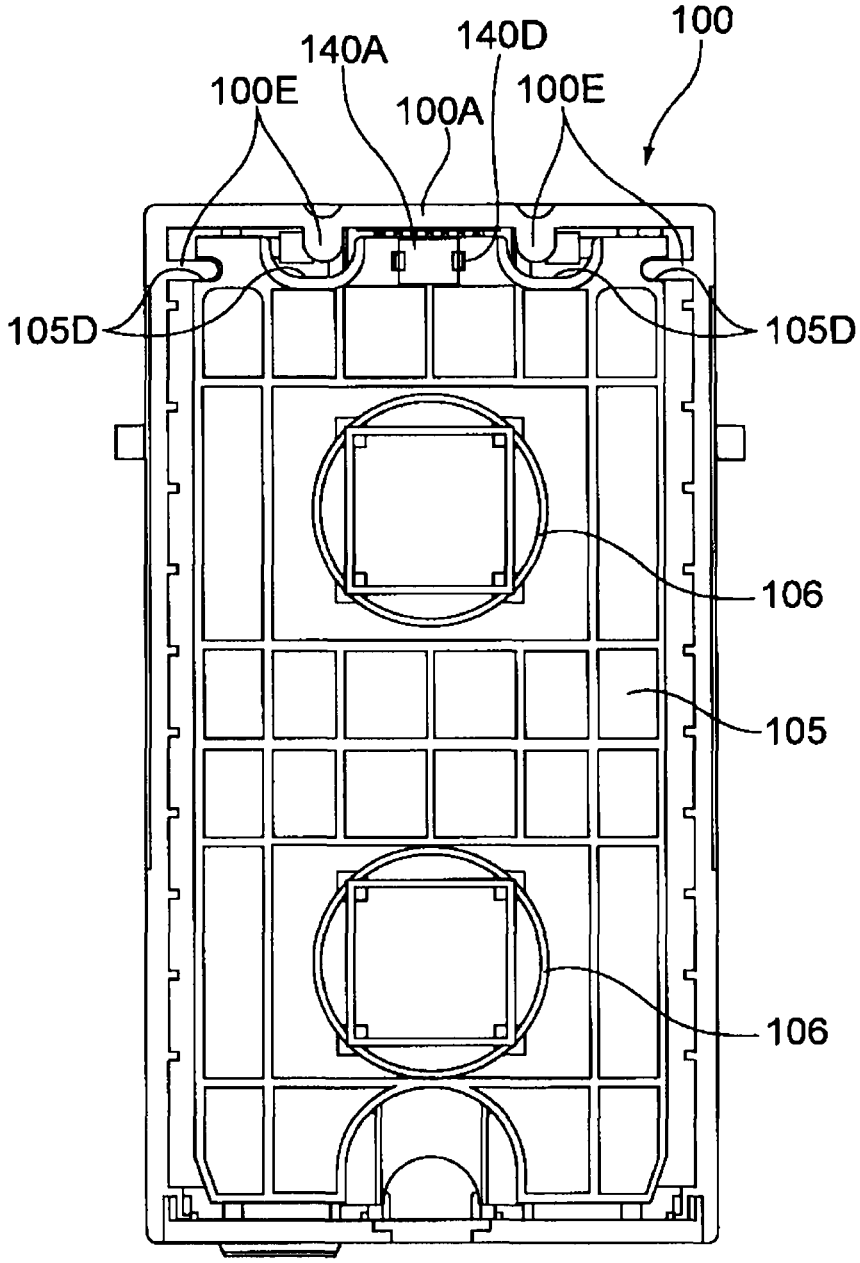
FIG. 9 is a front view showing the placing plate as viewed from back side in FIG. 8.
Figure 10:
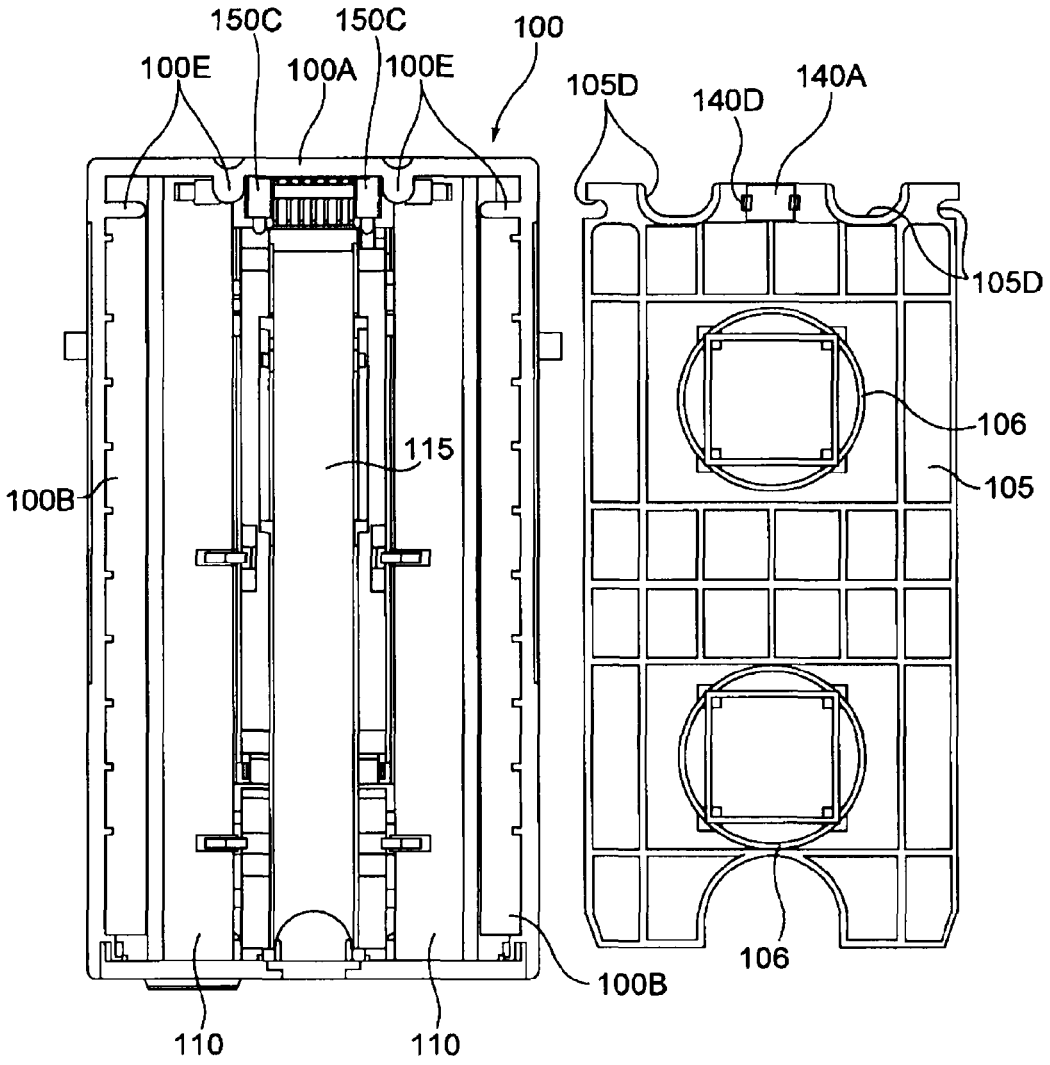
FIG. 10 is a front view showing the main body frame of the bill housing part with the placing plate removed.
Figure 11:
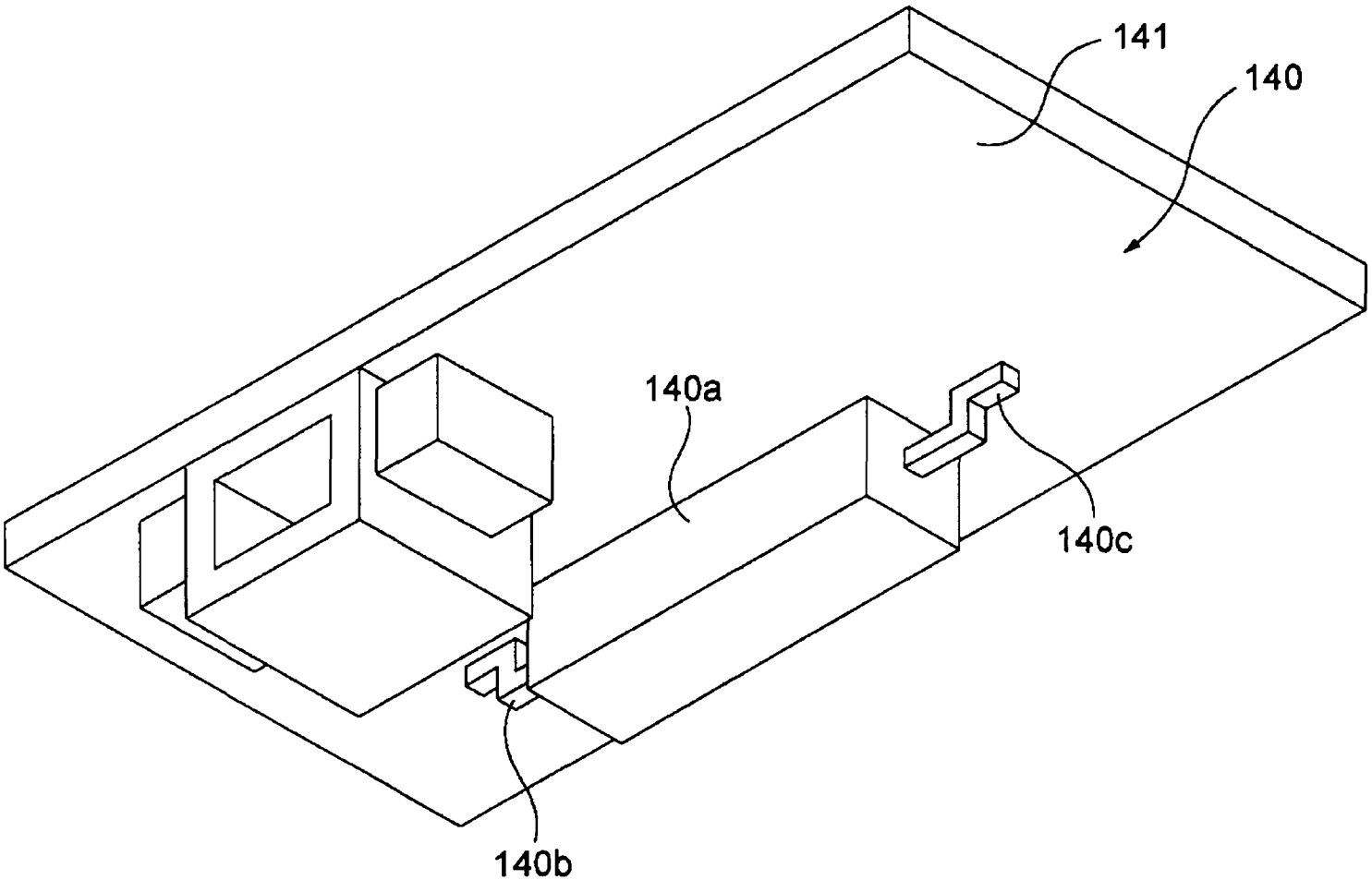
FIG. 11 is a view showing an example of a configuration of a magnetic sensor implemented on a sensor board.
Figure 12:
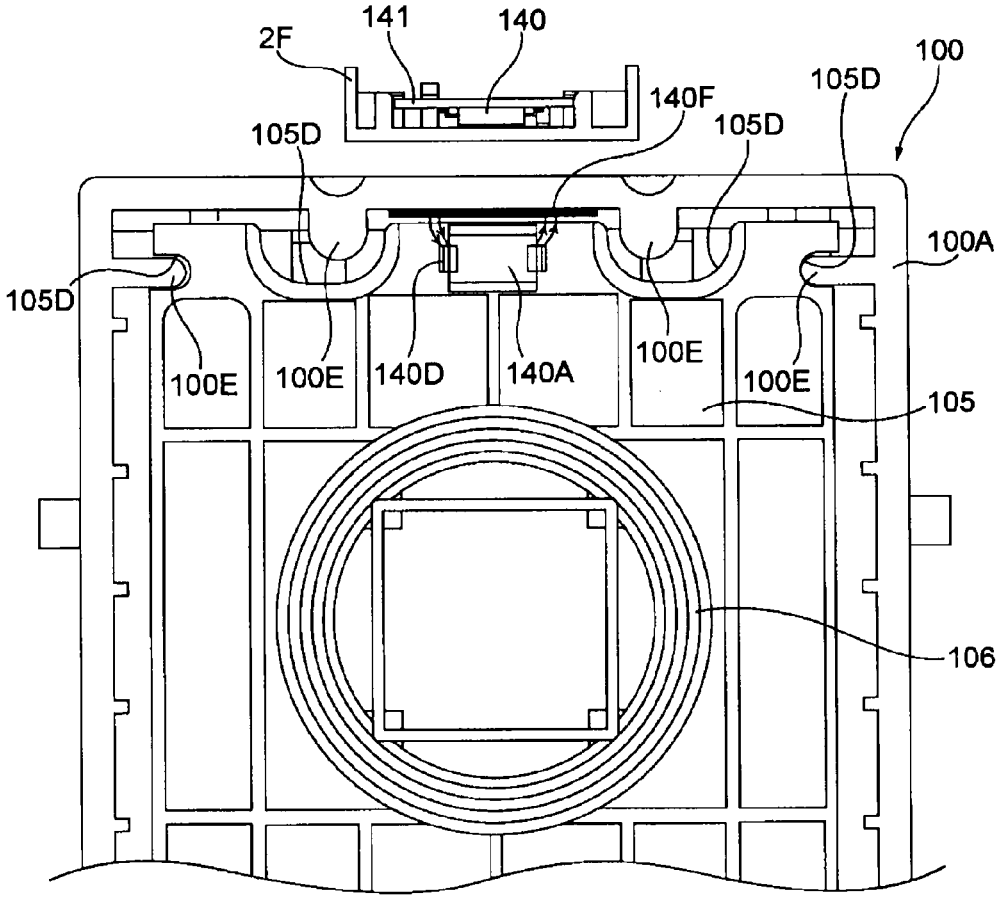
FIG. 12 is a view showing a relationship between a magnet and a magnetic sensor.
Figure 13:
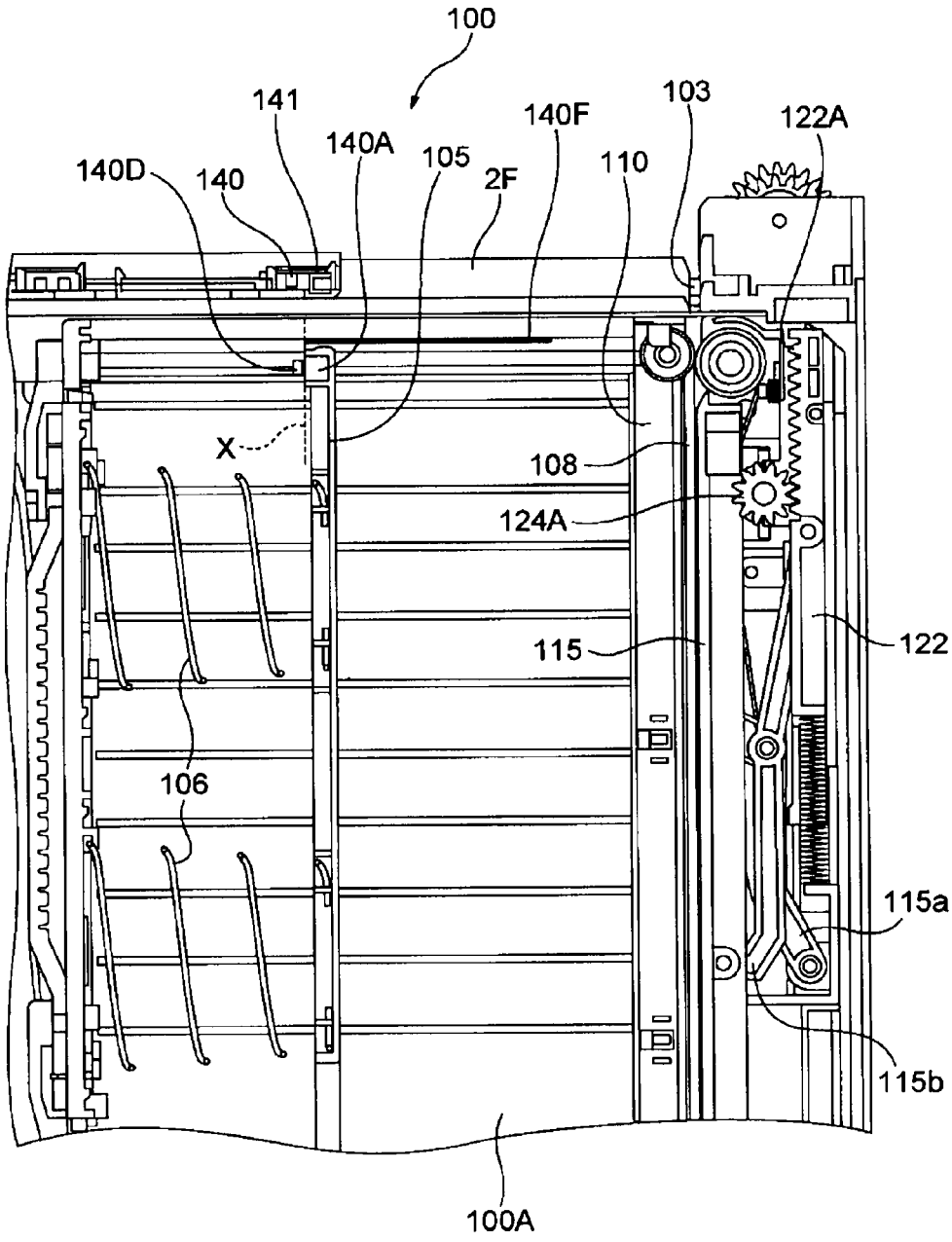
FIG. 13 is a side view showing a state that the magnetic sensor is not detecting magnetism from the magnet because of a shield body.
Figure 14:
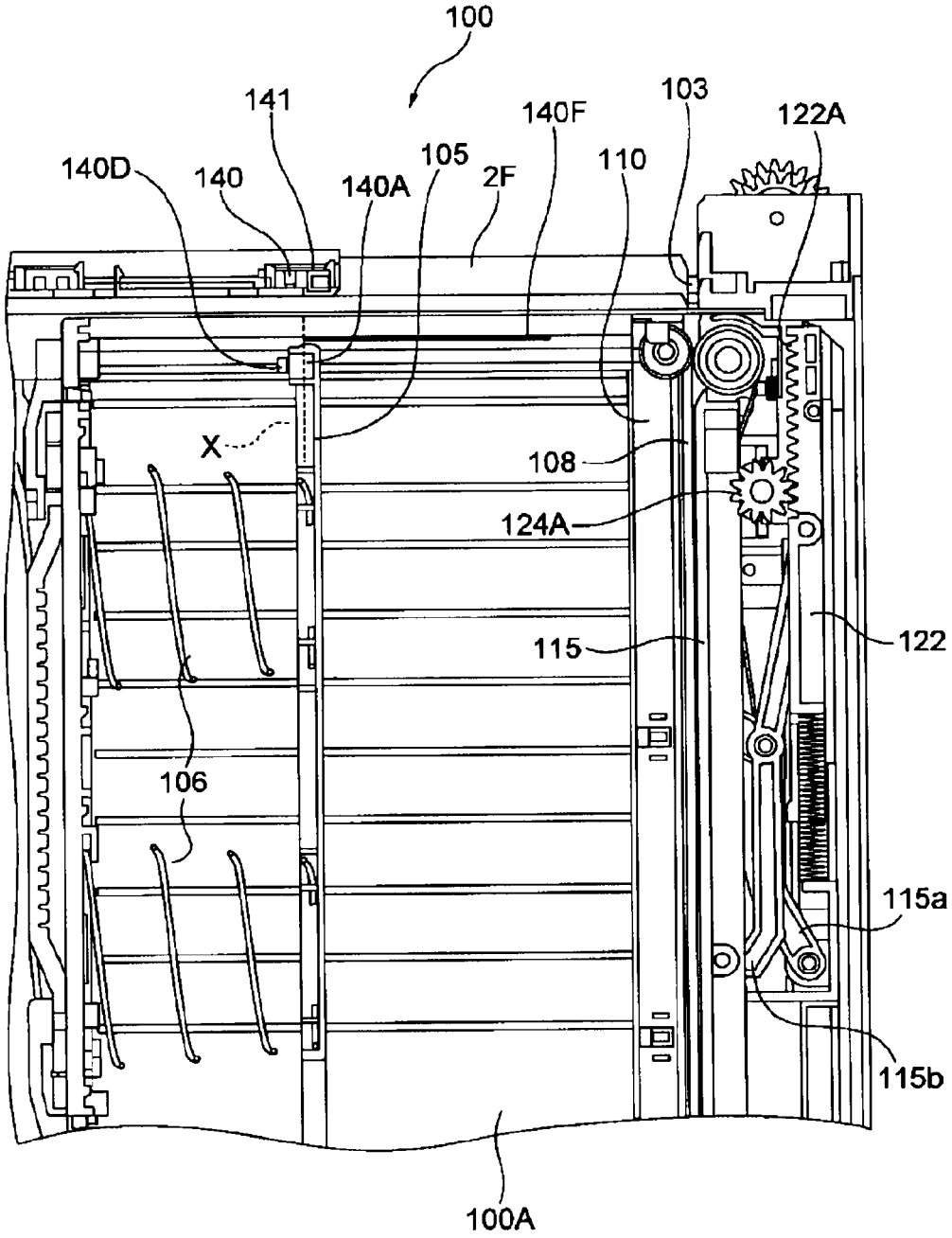
FIG. 14 is a side view showing a state that the magnetic sensor detects magnetism from the magnet.

Note that, among these drawings, FIG. 8 is a perspective view showing an interior configuration of the bill housing part, FIG. 9 is a front view of the placing plate as viewed from a back side in FIG. 8, FIG. 10 is a front view showing the main body frame of the bill housing part with the placing plate removed, FIG. 11 is a view showing an example of a configuration of the magnetic sensor implemented on the sensor board, FIG. 12 is a view showing a relationship between a magnet and the magnetic sensor, FIG. 13 is a side view showing a state that the magnetic sensor is not detecting magnetism of the magnet because of a shield body, and FIG. 14 is a side view showing a state that the magnetic sensor detects the magnetism of the magnet.

As shown in FIG. 7, the main body frame 100A constituting the bill housing part 100 is formed into a substantially rectangular parallelepiped (or cuboid) shape, and one end of bias means (e.g., bias spring) 106 is attached to an interior side of a front wall 102*a* thereof, and a placing plate 105 on which bills to be fed via the above-described receiving port 103 are sequentially stacked is provided to the other end thereof. Therefore, the placing plate 105 is in a state that it is pressed toward the presser plate 115, which will be described later, by the bias means 106. The placing plate 105 has a plate shape and a plate area larger than those of a bill to be housed and it is possible to place and house a bill in a state that wrinkles and bent portions are stretched and bills are housed in a vertical manner in a housing space defined by the main body frame 100A such that the placing plate 105 can slide to-and-fro in the housing space to be described later by a biasing force of the biasing means (spring) and a pressing force of the presser plate as a counter force to the biasing force. The housing space of the main body frame 100A comprises, in the order from the back side, a compartment in which the presser plate driving mechanism 120 of the presser plate 115; a compartment of the press standby part 108; a compartment of regulatory members 110 and an opening 110A; and a compartment in which bills are stacked and housed onto the placing plate 105.

In the main body frame 100A, as shown in FIGS. 4 and 5, the presser standby part in which bills having dropped from a receiving port 103 are kept and held is provided. A pair of regulatory members 110 are extending in a vertical direction and disposed on both sides of the placing plate 105 of the press standby part 108. An opening 110A, through which the presser plate 115 passes in a process of successively stacking bills onto the placing plate 105, is formed between the pair of regulatory members 110.

Further, protruding walls 100B are formed on both side walls inside the main body frame 100A such that the placing plate 105 may hit and contact thereon when the placing plate is pressed by the biasing means 106. The protruding walls 100B fulfill a role to stably hold the stacked bills by hit and contact on both sides of the uppermost bill of the stacked bills when the presser plate 105 is biased by the biasing means as bills are successively stacked on the placing plate 105. The protruding walls 100B are provided with contact faces for hitting and contacting the placing plate 105 thereon as they are flush with faces of the pair of regulatory members 110 on the presser plate 105 side. Therefore, the faces of the protruding walls 100B and the regulatory members 110 are substantially parallel to the placing face of the placing plate 105, thereby enabling the housed bills to be stably held.

Further, the presser plate 115 that presses bills having fallen in the press standby part 108 from the receiving port 103 toward the placing plate 105 is arranged in the main body frame 100A. The presser plate 115 is formed in such a size that it may be capable of reciprocating through an opening formed between the pair of regulatory members 110 and is driven to reciprocate between a position (pressing position) where the bills are pressed onto the placing plate 105 and another position (initial position) where the press standby part 108 is opened.

The presser plate 115 is driven to reciprocate as described above via a presser plate driving mechanism 120 installed in the main body frame 100A. The presser plate driving mechanism 120 comprises a pair of link members 115*a* and 115*b* having respective ends thereof supported pivotally by the presser plate 115 so as to allow the presser plate 115 to reciprocate in an arrow A direction in FIG. 5, and these link members 115*a* and 115*b* are connected in a shape of letter "X", and the other ends opposite to the respective ends are supported pivotally by a movable member 122 installed movably in a vertical direction (an arrow B direction). A rack 122A is formed in the movable member 122 along an arrow B direction and geared (engaged) with a pinion 124A constituting the presser plate driving mechanism 120 (the pinion is arranged coaxially with the gear 124B in FIG. 5).

As shown in FIG. 5, a housing part side gear train 124 constituting the presser plate driving mechanism 120 is connected to the pinion. In this case, in this embodiment, as shown in FIGS. 3 and 5, a driving source (a motor 20) and a main body side gear train 21 sequentially engaged with the motor 20 are installed in the above-described apparatus main body 2, and when the bill housing part 100 is mounted to the apparatus main body (stand 2D), the main body side gear train 21 is to be connected to the housing part side gear train 124. The housing part side gear train 124 comprises a gear 124B installed coaxially with the pinion and gears 124C, 124D to be engaged sequentially with the gear 124B, and when the bill housing part 100 is mounted to and demounted from the apparatus main body 2, the gear 124D is configured to be engaged with and disengaged from a final gear 21A of the main body side gear train 21.

As a result therefrom, the presser plate 115 is driven to reciprocate in the arrow A direction as the motor 20 installed in the apparatus main body 2 is driven to rotate so as to drive the main body side gear train 21 and in turn the presser plate driving mechanism 120 (the housing part side gear train 124, the rack 122A formed in the movable member 122, and the link members 115*a*, 115*b*, etc.).

The magnetic sensor 140 detecting that a predetermined number of bills are placed on the placing plate 105 is installed inside the frame 2A of the apparatus main body 2. As described above, the magnetic sensor 140 is implemented on the sensor board 141 disposed on the plate 2F interposed between the frame 2A and the stand 2D that constitutes the apparatus main body 2 and the magnetic sensor 140 may be constituted of a lead switch. The lead switch may be configured, for example, by disposing two ferromagnetic leads 140*b* and 140*c* opposing each other across a contact interval inside a glass tube 140*a* as shown in FIG. 11. That is, when a magnetic field equal to or greater than a predetermined amount (set as a threshold value) is applied to the glass tube 140*a*, the leads 140*b* and 140*c* become magnetized, attract each other inside the glass tube 140*a*, and form a closed circuit to generate a detection signal (and when the magnetic field is removed, the respective leads become separate due to their resilience and the circuit becomes open). The magnet 140A that applies the magnetic field to the magnetic sensor 140 is fixed via a holder 140D disposed at a central portion of a rear surface (facing a front wall 102*a* side) of the placing plate 105 of the bill housing part 100.

The magnetic sensor 140 is installed at a predetermined position in a direction in which the placing plate 105 is pressed by the presser plate 115, the placing plate 105 is pressed by the presser plate 115 against the biasing force of the biasing means 106, and by a loaded amount of bills on the placing plate 105 increasing and then exceeding a predetermined number of bills, the magnetic field caused by the magnet 140A becomes detected and the detection signal is generated. The position at which the magnetic sensor 140 is installed (the position at which the threshold value is exceeded and the detection signal is generated) is determined in advance according to a size of the bill housing part to be mounted, and in this embodiment, the magnetic sensor 140 is installed so that the detection signal is generated before the bills loaded on the placing plate 105 reaches a predetermined number of bills determined in advance and specifically when the loaded bills reach a number of bills slightly less (nine bills in the present embodiment) than the predetermined number of bills in consideration of safety, handling property, etc., to be described later.

In this case, the magnetic sensor 140 (sensor board 141) may be installed at a plurality of locations along the pressing direction of the presser plate 115. For example, by installing a magnetic sensor 140B of the same kind on a further inner side along the pressing direction from the magnetic sensor 140 as shown in FIG. 7, it is also possible to detect another number of bills in relation to the bills housed in the bill housing part 100. This configuration is in consideration because another kind of bill housing part 100 having a different housing capacity may be mounted to the stand 2D, and the other kind of bill housing part 100 having another housing capacity may be mounted to the same apparatus main body 2, which can accept different kinds of bill housing parts. For example, by letting respective sensors operate independently, the number m1 of bills which is to be detected by the magnetic sensor 140 and the number m2 of bills which is to be detected by the magnetic sensor 140B can be recognized independently.

Also, in the above-mentioned configuration, it is preferable that shield body 140F, which shields magnetism for the magnetic sensor 140, is to be installed along the movement direction of the placing plate 105 between the magnetic sensor 140 and the magnet 140A. The shield body 140F is formed as a plate extending along the movement direction of the placing plate 105 and having a width larger than that of the magnet 140A, so as to be attached to a rear surface of the main body frame 100A of the bill housing part 100. The shield body 140F is made of a material having high magnetic permeability, such as iron, iron-nickel alloy (permalloy), and so on, such that the magnetism from the magnet 140A passes inside the shield as shown by arrows in FIG. 12 so as to prevent the magnetic sensor 140 from detecting the magnetism. The magnetic sensor 140, as described above, is implemented on the sensor board 141 installed on the plate 2F disposed between the stand 2D and the frame a2 constituting the apparatus main body 2 such that the magnetic sensor 140 stays still and does not move even though the presser plate 105 moves. On the other hand, the magnet 140A fixed to a holder 140D disposed on a rear side of the placing plate 105 moves along with the placing plate 105 as the stacked amount of bills is increased. Therefore, a relative position movement between the immovable magnetic sensor 140 (sensor board 141) and the movable magnet 140A occurs. Here, as understood from FIG. 7, the sensor board 141 is arranged substantially parallel to an upper plate of the main body frame 100A and aligned substantially parallel to the movement direction of the magnet 140A to make a positional relationship. As shown in FIG. 12, the shield body 140F is formed with an equivalent size of width or wider and is also arranged substantially parallel to the sensor board 141. And the shield body 140F extends in a direction of movement of the placing plate 105 (i.e., magnet 140A). Therefore, the shield body 140F is disposed between the immovable sensor board 141 and the moveable magnet 141 such that they would not face with each other. When the placing plate 105 moves to a predetermined position where the magnetism of the magnet 140A is detectable by the magnetic sensor 140, a predetermined process may be performed in accordance with the detected magnetism. The above-mentioned predetermined position, for example, may mean a position of the placing plate 105 (dotted line X as shown in FIGS. 13 and 14) when the magnet 140A reaches the end portion of the shield body 140F on the front wall 102*a* side. If the magnet 140A moves beyond the above-mentioned position, the sensor board 141 and the magnet 140A directly faces with each other in magnetism. That is, the magnetism emitted by the magnet 140A can become directly detected.

Along with the movement of the placing plate 105 as the stacked amount of bills is increased, the magnet 140A moves with respect to the shield body 140F, and the position on which the amount of magnetism can be detected by the magnetic sensor 140 can be set accurately in association with the threshold value corresponding to the predetermined number of bills. That is, as shown in FIG. 13, when the magnet 140A is located on the presser plate side from the end portion of the shield body 140F (indicated by a dotted line X), the magnetic sensor 140 does not detect a magnetic field; and as shown in FIG. 14, when the magnet 140A moves on the presser spring side beyond the end portion of the shield body 140F (indicated by a dotted line X), the magnetic sensor 140 detects a magnetic field.

In particular, by installing the above-described shield body 140F, it becomes possible to accurately manage the magnetism detected by the magnetic sensor 140 and accurately detect the position of the placing plate 105 (the predetermined number of bills) without being influenced by characteristics of the magnet 140A and the magnetic sensor 140. This is because it is more preferable that the magnetic field strength is drastically changed as the magnet starts to show its face from the shield body such that the change may be utilized as a switching signal while the magnetic field strength gradually increases as the distance therebetween decreases because the magnetism spread in a 3D manner.

Also, it is preferable that, in the above-described structure, the magnetic sensor 140 and the magnet 140A are installed at a central position in a width direction of the placing plate 105 on which the bills are stacked as shown in FIGS. 7 and 9. As the bills are stacked onto the placing plate 105, a balance in the width direction may be disrupted depending on circumstances of conveying bills into the bill housing part, etc., but it is possible to detect stably a stacking condition of the bills by placing the magnetic sensor 140 and the magnet 140A at the central position of the placing plate even if the balance in the width direction is disrupted.

In particular, in this embodiment, guide means is provided to enable the placing plate 105 to move inside the main body frame 100A in a stable state. The guide means may be configured with a pair of members including a rail and a sliding member along the rail. For example, it may be configured with recesses 105D respectively formed on side peripheries on both left and right sides and top peripheries on both left and right sides disposed respectively across the mounted magnet 140A; and protrusions 100E formed in a consecutive rib-like shape extending along the movement direction of the placing plate 105 on the respective interior walls of the main body frame 100A to guide these recesses 105D. It is more preferable that such kind of guide means is provided on an upper part of the placing plate 105. In this way, it may not be necessary for the bottom end part to support all own weight of the placing plate 105 on a bottom end thereof.

As described above, since the guide means is provided on the placing plate 105 and the main body frame 100A, disruption of balance is prevented even when the placing plate 105 is pressed such that the position of the placing plate 105 (the predetermined number of bills) may be detected more accurately. Thus, the placing plate 105 slides along the guide means.

Conveyor members 150 which are capable of touching the bill conveyed-in from the receiving port 103 are installed in the main body frame 100A of the bill housing part 100. The conveyor members 150 take their own role to contact the bill conveyed-in so as to stably guide the bill into an appropriate position in the press standby part 108 (position where the bill can be stably pressed without causing the bill to be moved to the right or left side when the bill is pressed by the presser plate 115). In this embodiment, the conveyor members are constituted of belt-like members (hereafter called belts 150) installed so as to face the press standby part 108.

In this case, the belts 150 are installed so as to extend along the conveying-in direction with respect to the bill, and are wrapped around the pair of pulleys 150A and 150B supported rotatably on both ends in the conveying-in direction. Further, the belts 150 contact a conveyor roller 150C extending in an axis direction which is supported rotatably in the region of the receiving port 103, and the belts 150 and the conveyor roller 150C nip and hold the bill conveyed-in the receiving port 103 therebetween to guide the bill directly to the press standby part 108. Here, in this embodiment, the pair of belts 150 are provided on the right and left sides, respectively, across the above-described presser plate 115 in order to be capable of contacting the surface on left and right sides of the bill. In addition, the belts 150 may be prevented from loosening by not only being wrapped around the pulleys 150A and 150B at the both ends, but also causing tension pulleys to push the belts 150 at the intermediate positions, respectively.

The pair of belts 150 are configured to be driven by the motor 13 that drives the above-described plurality of conveyor rollers installed in the apparatus main body 2. In detail, as shown in FIG. 6, the above-described driving belt 13B driven by the motor 13 is wrapped around a pulley 13D for the driving force transmission, and a gear train 153 installed at the end of the spindle of the pulley 150A supported rotatably on the receiving port 103 side is engaged with a gear train 13E for the power transmission sequentially installed onto the pulley 13D. That is, when the bill housing part 100 is mounted to the apparatus main body 2, an input gear of the gear train 153 is configured to be engaged with a final gear of the gear train 13E, and the pair of belts 150 are configured to be driven to rotate in a synchronized manner with the above-described conveyor rollers 14B, 15B 16B, and 17B for conveying the bill by driving the motor 13 to rotate.

Also, the above-mentioned presser plate detecting sensor 23 is configured to be capable of detecting a position of the presser plate 115 that presses the bill toward the placing plate 105, and further, to be capable of detecting the mounting or demounting operation when the bill housing part 100 is mounted to or demounted from the frame 2A (stand 2D) of the apparatus main body 2.

Figure 15:
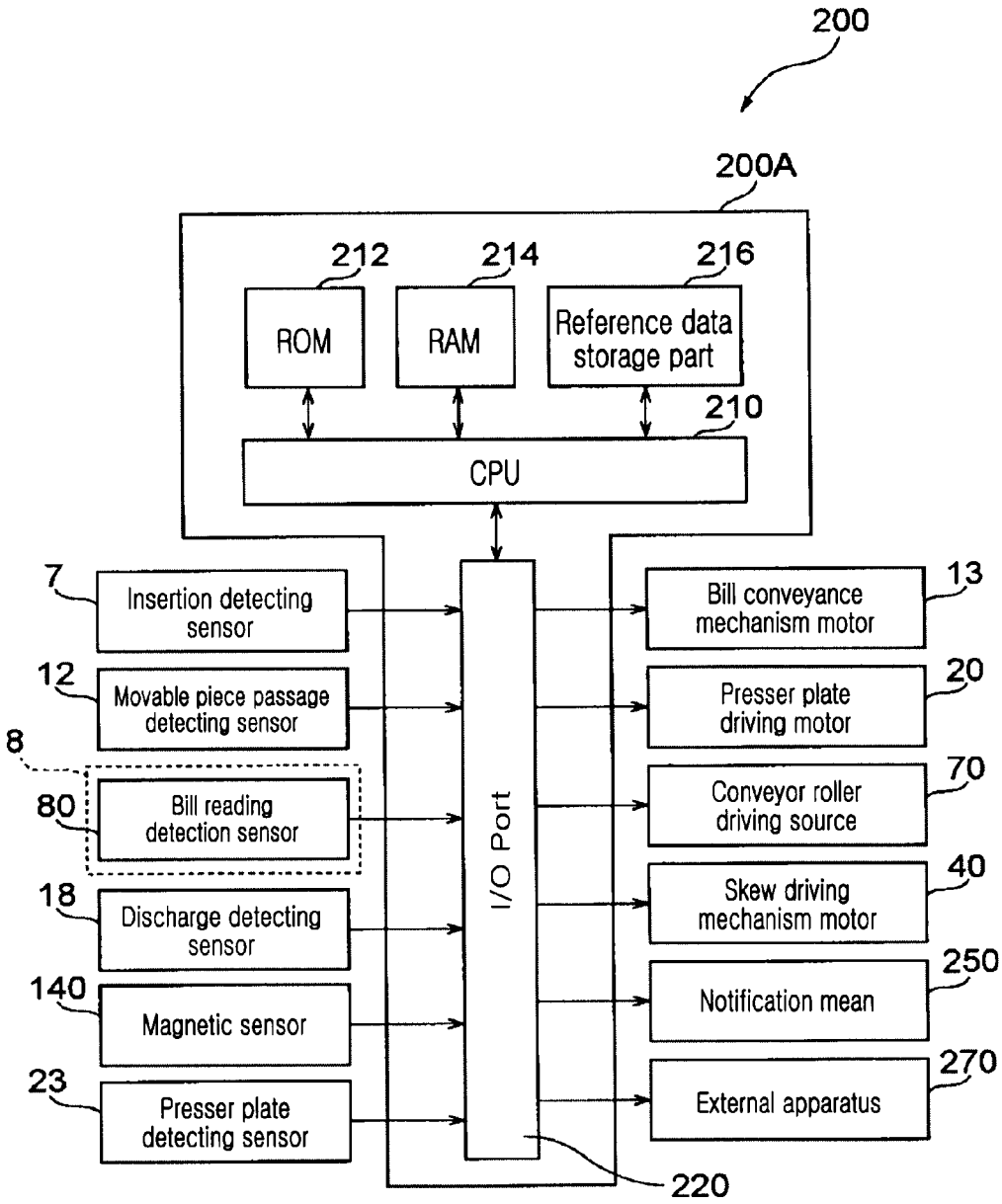
FIG. 15 is a block diagram showing a configuration of control means for controlling an operation of a bill processing apparatus.
Figure 16:
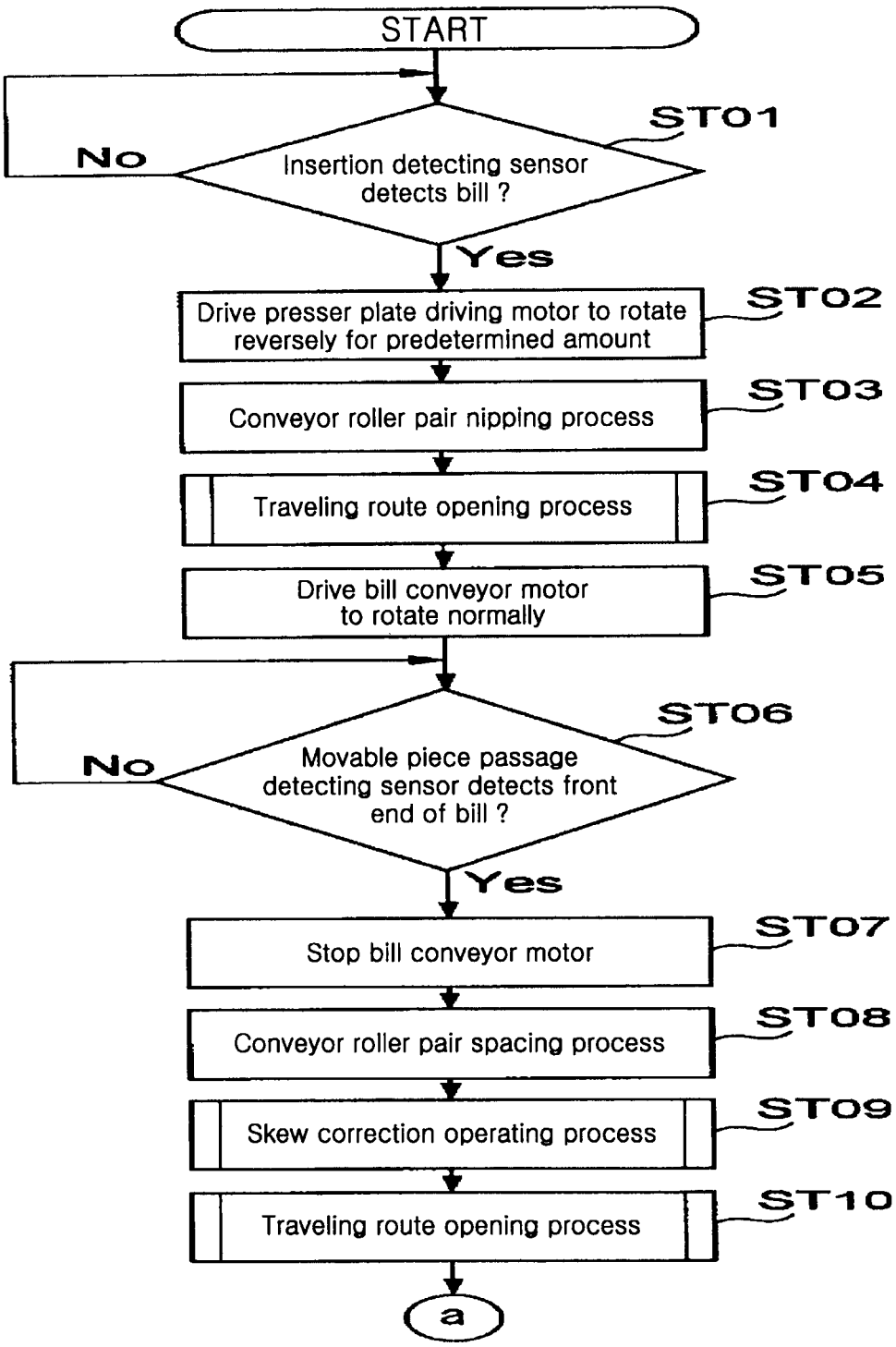
FIG. 16 shows a flowchart (part one) illustrating processing operations for processing a bill in a bill processing apparatus of this embodiment.
Figure 17:
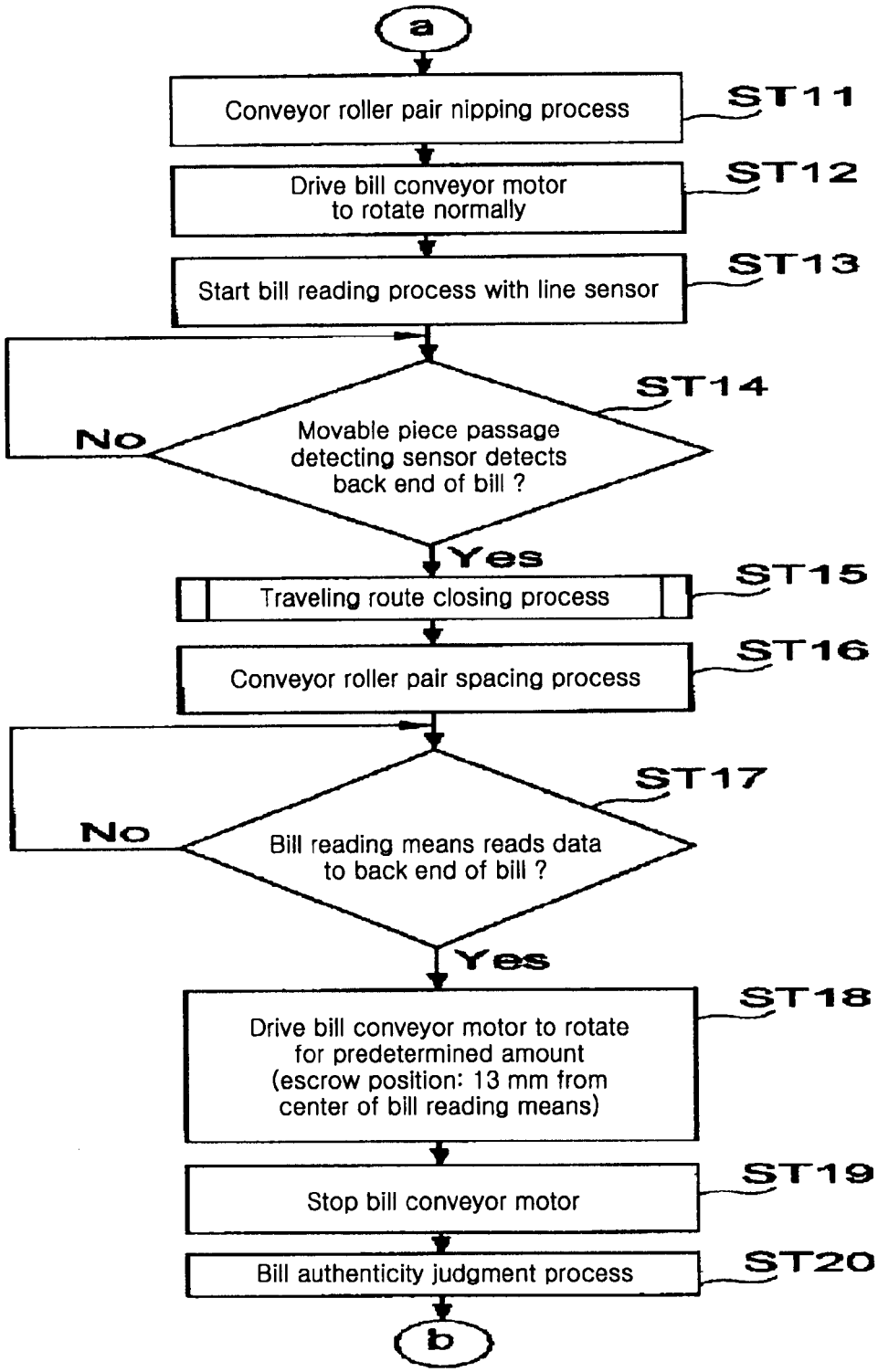
FIG. 17 shows a flowchart (part two) illustrating processing operations for processing a bill in a bill processing apparatus of this embodiment.
Figure 18:
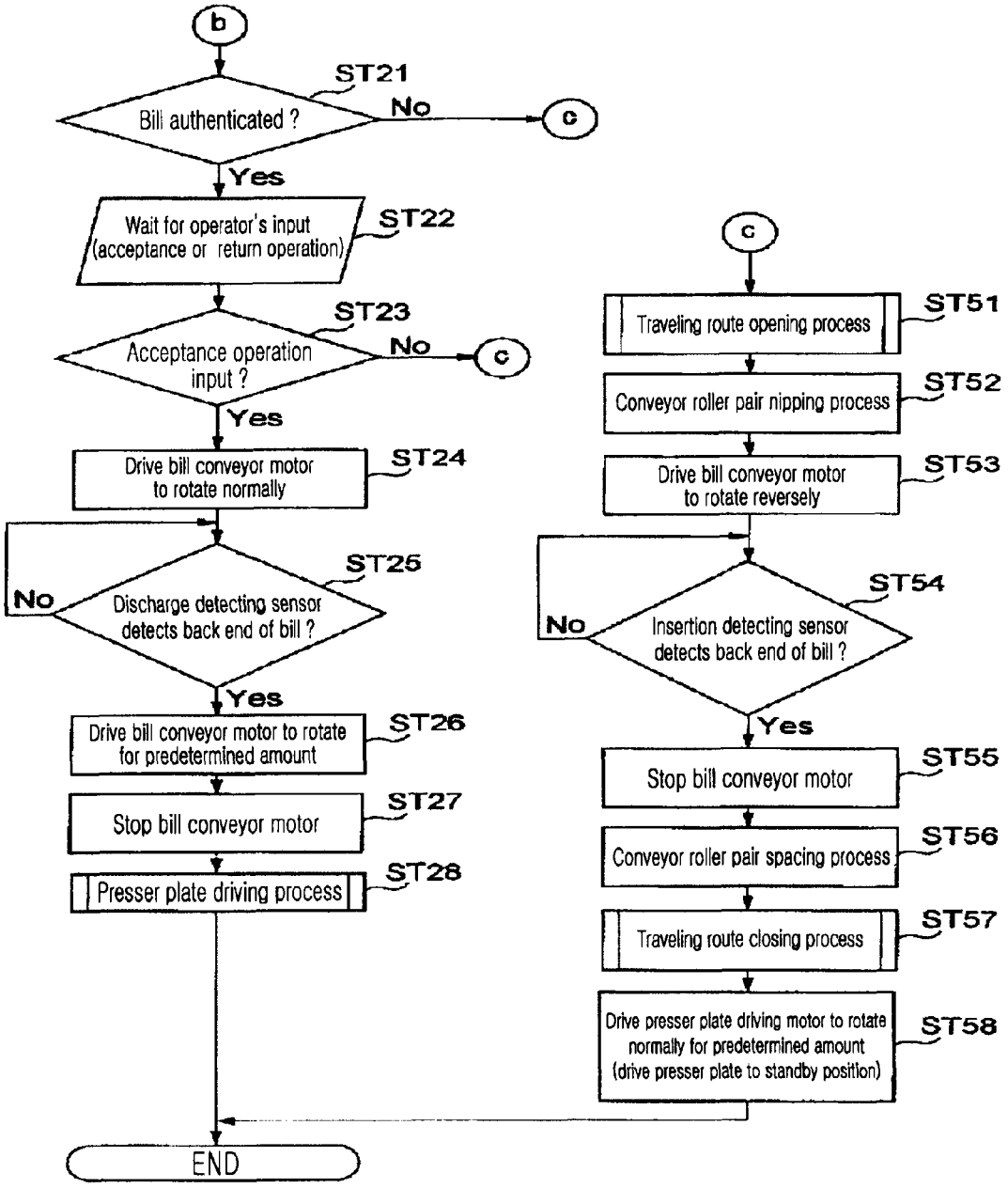
FIG. 18 shows a flowchart (part three) illustrating processing operations for processing a bill in a bill processing apparatus of this embodiment.
Figure 19:
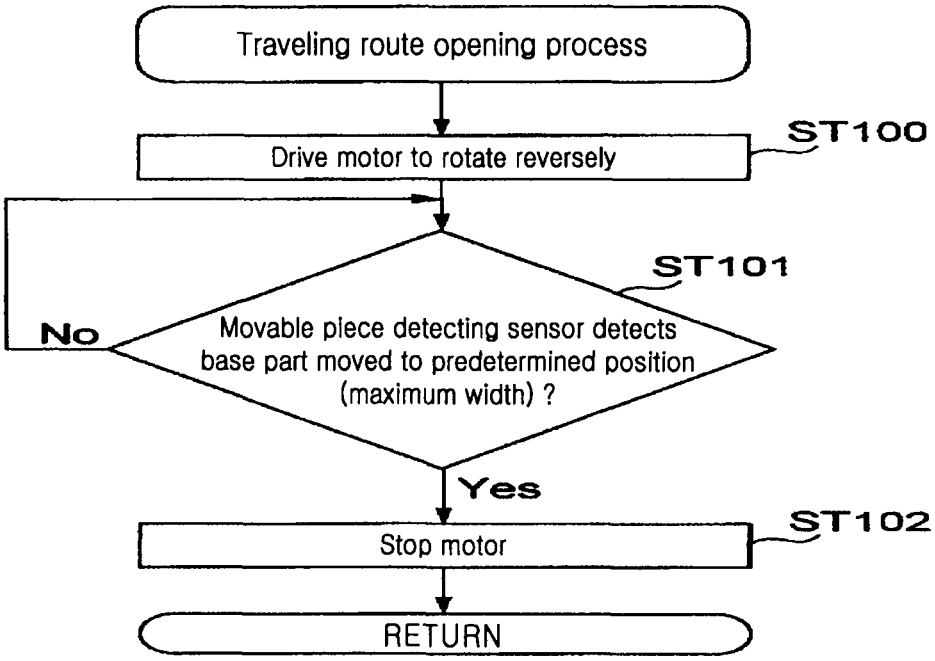
FIG. 19 shows a flowchart illustrating processing operations of a traveling route opening process.

Next, the control means for controlling operations of the above-mentioned paper sheet processing apparatus will be explained with reference to FIG. 15.

The control means 200 comprises a control circuit board 200A that controls the operations of the above-described respective drive units, and a CPU (Central Processing Unit) 210 constituting bill identification means, a ROM (Read Only Memory) 212, a RAM (Random Access Memory) 214, and a reference data storage part 216 are mounted on the control circuit board.

In the ROM 212, various types of programs such as operation programs for the respective drive units such as the motor 13 that drives the above-described bill conveyance mechanism, the motor 20 that drives the presser plate, the driving source 70 that drives the conveyor roller 14A to contact/be spaced from the conveyor roller 14B, the motor 40 to drive the skew driving mechanism 10; an authenticity judgment program for the bill read by the bill reading means 8; and permanent data are stored. The CPU 210 generates control signals according to the programs stored in the ROM 212, carries out the input and output of the signals with respect to the respective drive units via an I/O port 220, and controls the driving of the respective drive units.

Further, detection signals from various types of sensors such as the insertion detecting sensor 7, the movable piece passage detecting sensor 12, the discharge detecting sensor 18, the magnetic sensor 140, the presser plate detecting sensor 23 for detecting the position of the presser plate 115, and the like are to be input to the CPU 210 via the I/O port 220, and the driving of the respective drive units is controlled on the basis of these detection signals. In this case, the CPU 210 has a function of so-called determination means that determines that the amount of magnetism from the magnet 140A mounted on the placing plate 105 has become equal to or greater than the threshold value when the detection signal is input from the magnetic sensor 140.

Further, data and programs used for the operation of the CPU 210 are stored in the RAM 214, and reference data used for the performance of a bill authenticity judgment, for example, various types of data acquired from all the printing areas of the legitimate bill (such as data about contrasting density and data about transmitted light or reflected light when the bill is irradiated with infrared ray) are stored as reference data in the reference data storage part 216. In addition, the reference data is stored in the dedicated reference data storage part 216. However, the data may be stored in the ROM 212.

Then, a bill reading detection sensor (for example, a line sensor) 80 constituting the above-described bill reading means 8 is connected to the CPU 210 via the I/O port 220, and bill reading data read by the bill reading detection sensor 80 is compared with the reference data stored in the reference data storage part 216 such that a bill authenticity judgment process is executed.

Further, the CPU 210 is configured to send, via the I/O port 220, a control signal (alarm signal) to notification means 250 and a management apparatus 270 that manages the bill processing apparatus 1. Here, the notification means 250 may be configured with a speaker that notifies the state by sound, a lamp that notifies the state visually, and the like, and when the detection signal from the above-described magnetic sensor 140 is generated, the CPU 210 sends a drive signal (alarm signal) to a drive circuit of the notification means to notify the state (that the number of bills in the bill housing part 100 has reached the predetermined number).

As configured in the aforementioned way, when the number of bills reaches the predetermined number, a manager or the like is notified of such a state, thereby enabling the manager or the like to find that the bill housing part has been full with the bills loaded therein.

Otherwise, when the detection signal is input from the magnetic sensor 140 to the CPU 210, the CPU 210 may be configured to send a signal (error signal) notifying that the number of bills has reached the predetermined number, for example, to the external apparatus 270 that manages a plurality of bill processing apparatuses 1.

As configured in this way, for example, the management apparatus (higher-level apparatus) that manages the bill processing apparatuses 1 can take care of processing when the bill housing part 100 becomes full of bills such that the bill housing part 100 may be removed from the specific bill processing apparatus at an appropriate timing.

As described above, when the aforementioned bill processing apparatuses 1 are installed in many gaming machines in a game hall or the like, an operating rate of the gaming machines can be improved by shortening necessary time (average recovery time) to exchange the bill housing parts 100 because respective timings for exchange of the bill housing parts 100 may be obtained appropriately. In the case of bill processing apparatuses that cannot detect respective positions of the aforementioned presser plates, a typical timing to exchange the bill housing parts 100 is in the time zone (for example, in the dawn) when the hall is scarcely crowded such that the bill housing parts of all the gaming machines are usually to be exchanged. However, the bill housing parts can be exchanged individually at appropriate timings because the error signals are independently sent to the external apparatus 270 whereby the average recovery time can be shortened such that the operating rate of the gaming machines can be improved. Also because each bill housing part 100 can be exchanged at an appropriate timing, a malfunction that occurs due to insertion of a new bill into a bill housing part that is already full can be prevented and it thus becomes possible to improve efficiency of maintenance.

Alternatively, the CPU 210 may be configured to stop the driving of the motor 13 for the bill conveyance mechanism so as to bring a state that the bill cannot be conveyed, that is, to make the aforementioned bill conveyance mechanism disabled since the detection signal is generated from the magnetic sensor 140 to notify that the bill housing part 100 has become full (or nearly full) with bills.

As configured in this way, the state that the bill cannot be conveyed is established although a user attempts to insert another bill when the bill housing part 100 has become full (or nearly full) with bills, and an additional bill beyond the predetermined number of bills is not conveyed such that it is possible to prevent each component of the bill housing part from breaking down.

Here, the timing at which the magnetic sensor 140 generates the detection signal (the number of bills stacked onto the placing plate; the setting of the predetermined number of bills) may be decided arbitrarily, and in this embodiment, for example, the predetermined number of bills to be housed is set to 400 by taking an allowance of approximately 100 bills with the current configuration having the maximum capacity of 500 bills in the interior space of the bill housing part 100 such that the magnetic sensor 140 is configured to generate the detection signal when the number of bills having stacked reaches a value less than the predetermined number by nine (9). As described above, it is possible to change the predetermined number of bills to be determined in advance as appropriate by changing the position of the magnetic sensor such that it can be effectively prevented components from breaking down.

In addition, the control means 200 that controls the operation of the bill processing apparatus is implemented on one control circuit board 200A as mentioned above. However, the control means 200 may be implemented in a distributed manner on separate control circuit boards in accordance with respective functions.

Next, the bill processing operation in the bill processing apparatus 1 executed by the control means 200 will be described with reference to the flowcharts of FIGS. 16 to 22.

When an operator inserts a bill into the bill insertion slot 5, the conveyor roller pair (14A and 14B) installed in the vicinity of the bill insertion slot is in a state that the rollers are spaced from each other in an initial stage (refer to ST16 and ST56 to be described later). Further, with respect to the presser plate 115, the pair of link members 115*a*, 115*b* driving the presser plate 115 are positioned in a pathway of the press standby part 108, and the presser plate 115 is so positioned (hereinafter, called "standby position") that the pair of link members 115*a*, 115*b* prevent the bill from being conveyed into the press standby part 108 from the receiving port 103 (refer to ST134 to be described later). That is, in this state, the presser plate 115 is brought into the opening 110A formed between the pair of regulatory members 110 such that the opening through which the bill passes is in an occluded state so as to prevent the bill stored in the bill housing part from being drawn out.

Moreover, the pair of movable pieces 10A constituting the skew correction mechanism 10 located on the downstream side of the conveyor roller pair (14A, 14B) are in a state that the pair of movable pieces 10A are moved to leave the minimum open width therebetween (for example, an interval between the pair of movable pieces 10A is 52 mm; refer to ST15 and ST57 to be described later) so as to prevent the bill from being drawn out in the initial stage.

When the above-described pair of conveyor rollers (14A and 14B) are in the initial state, the operator easily insert a wrinkled bill into the bill insertion slot 5. Then, when the insertion detecting sensor 7 detects the insertion of the bill (ST01), the driving motor 20 of the above-described presser plate 115 is driven to rotate reversely for a predetermined amount (ST02) to move the presser plate 115 to the initial position. In this initial position, the press standby part 108 is in an open state (refer to FIG. 5), and the bill can be conveyed into the inside of the bill housing part 100. That is, by driving the motor 20 to rotate reversely for a predetermined amount, the presser plate 115 is driven from the aforementioned standby position to the initial position via the main body side gear train 21 and the presser plate driving mechanism 120 (the housing part side gear train 124, the rack formed on the movable member 122, and the link members 115*a* and 115*b* etc.). The press standby part 108 is opened by the movement of the presser plate 115 such that the bill can be conveyed into the inside of the bill housing part.

In this state, the above-described driving source 70 is driven to move the upper conveyor roller 14A so as to make a contact with the lower conveyor roller 14B. In accordance therewith, the inserted bill is nipped and held therebetween by the pair of conveyor rollers (14A and 14B) (ST03).

Next, a traveling route opening process is conducted (ST04). The opening process is conducted by driving the pair of movable pieces 10A to move in separating directions so as to become apart with each other as the motor 40 for the skew correction mechanism is driven to rotate reversely as shown in the flow chart of FIG. 19 (ST100). At this time, when it is detected that the pair of movable pieces 10A have moved to the predetermined positions (the maximum open width positions) by the movable piece detecting sensor that detects positions of the pair of movable pieces 10A (ST101), the driving operation to rotate the motor 40 reversely is stopped (ST102). This traveling route opening process allows the bill to enter between the pair of movable pieces 10A. In addition, in the previous step of ST04, the bill traveling route 3 is in a closed state by a traveling route closing process (ST15, ST57) to be described later. Thus, the bill traveling route 3 is closed in this way before an insertion of the bill so as to prevent an element such as a line sensor from being broken by, for example, inserting a plate-like member from the bill insertion slot for illicit purposes or the like.

Next, the bill conveyor motor 13 is driven to rotate normally (ST05). The bill is carried into the inside of the apparatus by the conveyor roller pair (14A and 14B), and when the movable piece passage detecting sensor 12 installed on the downstream side from the skew correction mechanism 10 detects the front end of the bill, the bill conveyor motor 13 is stopped (ST06 and ST07). At this time, the bill is located between the pair of movable pieces 10A constituting the skew correction mechanism 10.

Next, the above-described driving source 70 is driven to allow the conveyor roller pair (14A and 14B) holding the bill therebetween to become apart from each other (ST08). At this time, the bill is in a state that no load is applied.

Figure 20:
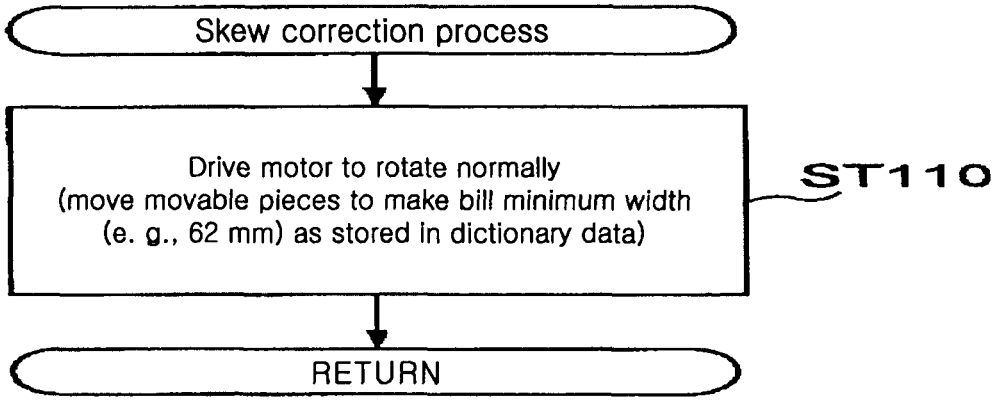
FIG. 20 shows a flowchart illustrating a skew correction operating process.

Then, a skew correction operating process is executed as the bill remains in this state (ST09). The skew correction operating process is conducted by driving the motor 40 for the skew correction mechanism to rotate normally to drive the pair of movable pieces 10A to get closer with each other. That is, in this skew correction operating process, as shown in the flowchart of FIG. 20, the motor 40 described above is driven to rotate normally to move the pair of movable pieces 10A in respective directions such that the pair of movable pieces 10A get closer with each other (ST110). The movement of the movable pieces is continued until the interval becomes the minimum width (example; width of 62 mm) of the bill registered in the reference data storage part in the control means, and the skew is corrected by the movable pieces 10A touching both sides of the bill such that the bill may be positioned at the accurate center position.

When the skew correction operating process as described above is completed, a traveling route opening process is subsequently executed (ST10). This process is conducted by moving the pair of movable pieces 10A in separating directions as the above-described motor 40 for the skew correction mechanism is driven to rotate reversely (refer to ST100 to ST102 of FIG. 19).

Next, the above-described driving source 70 is driven to move the upper conveyor roller 14A to contact the lower conveyor roller 14B, and the bill is nipped and held between the pair of conveyor rollers (14A and 14B) (ST11). Thereafter, the bill conveyor motor 13 is driven to rotate normally to carry the bill into the inside of the apparatus, and when the bill passes through the bill reading means 8, a bill reading process is executed (ST12 and ST13).

Figure 21:
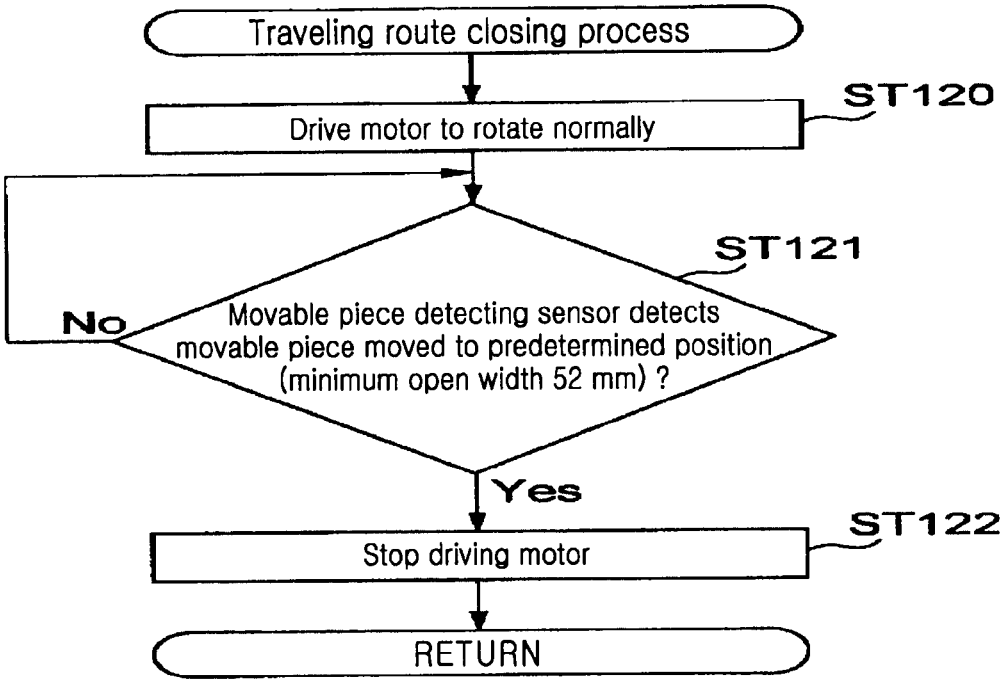
FIG. 21 shows a flowchart illustrating processing operations of a traveling route closing process.

Then, when the bill to be carried passes through the bill reading means 8, and the trailing end of the bill is detected by the movable piece detecting sensor 12 (ST14), a process for closing the bill traveling route 3 is executed (ST15). In this process, first, as shown in the flowchart of FIG. 21, after the trailing end of the bill is detected by the movable piece detecting sensor 12, the above-described motor 40 is driven to rotate normally to move the pair of movable pieces 10A in respective directions such that the pair of movable pieces 10A get closer with each other (ST120). Next, when it is sensed by the movable piece detecting sensor that the movable pieces 10A move to the predetermined positions (minimum open width positions: for example, width of 52 mm) (ST121), the driving operation of the normal rotation of the motor 40 is stopped (ST122).

With this traveling route closing process, the pair of movable pieces 10A are moved to the minimum open width positions (width of 52 mm) narrower than the width of any bill allowed to be inserted, thereby effectively preventing the bill from being drawn out. That is, by executing such a bill traveling route closing process, an opening distance between the movable pieces 10A is made shorter than the width of the inserted bill, thereby enabling the effective prevention of an action of drawing-out the bill in the direction toward the insertion slot by the operator for illicit purposes.

In addition, when the movable piece detecting sensor as described above detects the movement of the movable pieces 10A in this state, it may be considered that the operator is committing some fraudulent activities such that a predetermined processes may be executed. For example, a fraudulent manipulated signal (an anomaly sensed signal) may be transmitted to a higher-level apparatus that manages the operations of the bill processing apparatus, or an annunciator lamp may be provided on the bill processing apparatus, and this lamp may flash, or without activating a process for input acceptance (ST22) input by another operator thereafter, a process in which a discharge operation or the like is forcibly carried out may be executed. Or, appropriate processes such as canceling the operation of the bill processing apparatus (for example, a process for stopping the processing, a process for discharging the bill, and the like) and the like may be executed.

Further, in succession to the traveling route closing process described above (ST15), a conveyor roller pair spacing process is executed such that the driving source 70 is driven to make the conveyor roller pair (14A, 14B) having been in a state capable of nipping and holding the bill therebetween separate from each other (ST16). By executing the conveyor roller pair spacing process, even if the operator additionally inserts (double insertion) another bill by mistake, the bill is not subject to a feeding operation by the conveyor roller pair (14A, 14B) and hits front ends of the pair of movable pieces 10A in a closed state according to ST15 such that it is possible to reliably prevent the operation of bill double-insertion.

Along with the bill traveling route closing process as mentioned above, when the bill reading means 8 reads the data up to the trailing end of the bill, the bill conveyor motor 13 is driven for a predetermined amount and leave the bill stopped at a predetermined position (escrow position; position where the bill is carried toward the downstream by 13 mm from the center position of the bill reading means 8), and at this time, a bill authenticity judgment process is executed by the control means 200 (ST17 to ST20).

In the bill authenticity judgment process at ST20 as described above, when the bill is judged as a legitimate bill (ST21; Yes), an input from the operator is received (ST22). This input corresponds to an acceptance operation in which the operator presses an acceptance button in order to accept provision of services (for example, in the case of a gaming device, an acceptance process accompanied by start of a game), and a return operation in which the operator presses a return button in order to execute a process for returning the inserted bill.

Then, when an operation to accept the provision of various types of services is input (ST23; Yes), the bill conveyor motor 13 is consecutively driven to rotate normally to convey the bill in this state toward the bill housing part 100 (ST24). While the bill is conveyed, the bill conveyor motor 13 is driven to rotate normally until the trailing end of the bill is detected by the discharge detecting sensor 18, and after the trailing end of the bill is detected by the discharge detecting sensor 18 (ST25), the bill conveyor motor 13 is driven to rotate normally by the predetermined amount (ST26 and ST27).

The process for driving the bill conveyor motor 13 to rotate normally in ST26 and ST27 corresponds to a driving amount for which the bill is conveyed in the receiving port 103 of the bill housing part 100 from the discharge slot 3*a* on the downstream side of the bill traveling route 3 of the apparatus main body 2 so that the pair of belts 150 contact the surface on both sides of the conveyed-in bill to guide the bill stably to the press standby part 108. That is, by further driving the bill conveyor motor 13 to rotate normally for a predetermined amount after the trailing end of the bill is detected by the discharge detecting sensor 18, the pair of belts 150 contact the bill conveyed-in and are driven in the bill feeding direction so as to guide the bill in a stable state to the press standby part 108.

Then, after the above-described bill conveyor motor 13 is stopped, the process for driving the presser plate 115 is executed (ST28) such that the bill is placed on the placing plate 105.

Figure 22:
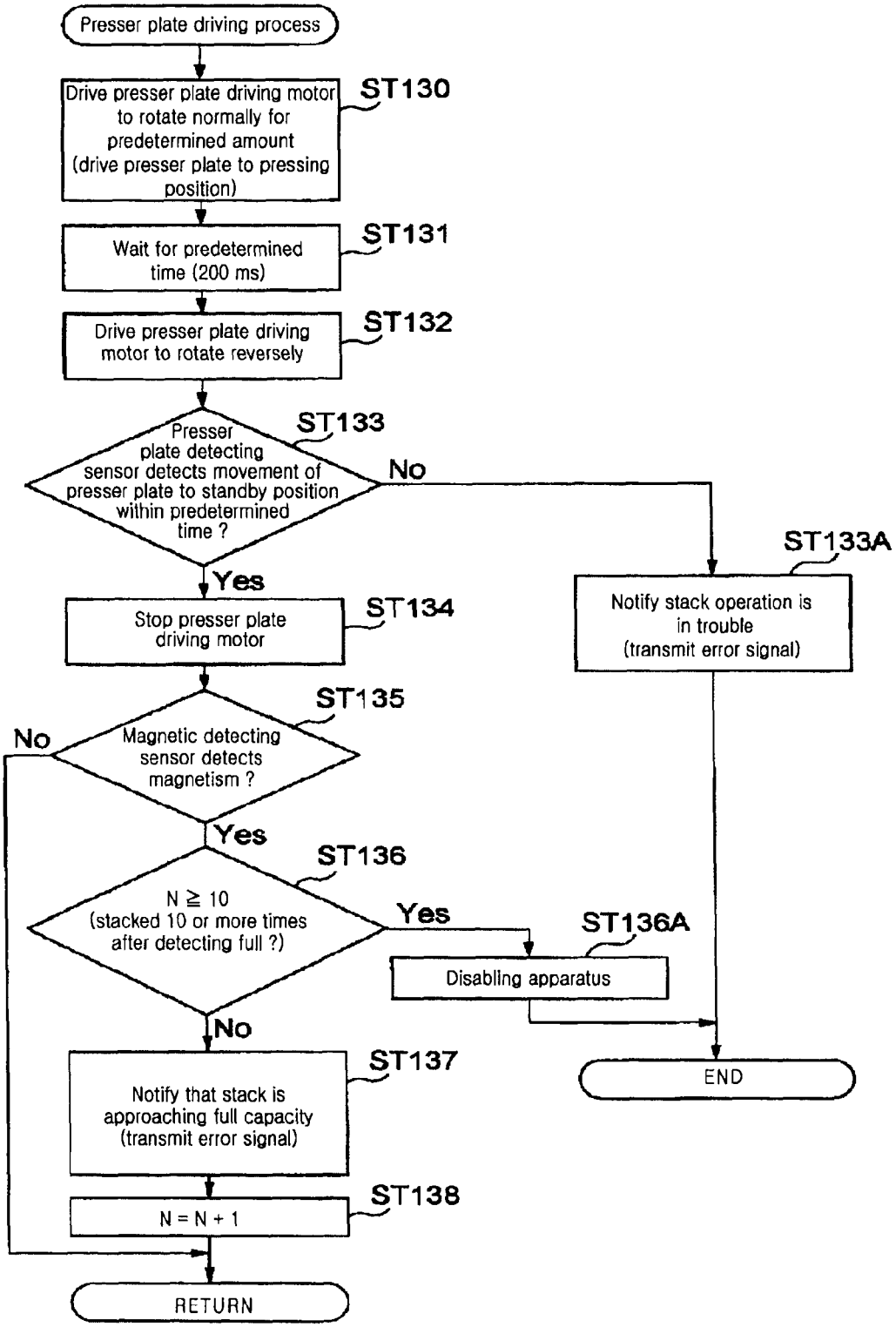
FIG. 22 shows a flowchart illustrating processing operations of a presser plate driving process.

The process for driving the presser plate 115 is executed in accordance with the flowchart as shown in FIG. 22. First, the driving motor 20 of the presser plate 115 is driven to rotate normally for a predetermine amount to move the presser plate 115 staying at the initial position in the above ST02 until it gets to the pressing position (ST130). With respect to the amount of driving to rotate normally the motor 20, if the motor 20 is composed of a DC motor, a predetermined amount of rotation can be set such that pulses are generated by utilizing, for example, an encoder and the number of the pulses is measured. That is, by driving the driving motor 20 to rotate normally for a predetermined amount, the presser plate 115 is moved from the initial position to the pressing position via the main body side gear train 21 and the presser plate driving mechanism 120 (the housing part side gear train 124, the rack formed on the movable member 122, and the link members 115*a* and 115*b* and so on).

According to the movement of the presser plate 115, the bill in the press standby part 108 passes through the opening 110A between the pair of regulatory members 110 so as to be deflected in a U-shape in a laterally symmetrical manner, and the bill is finally pressed onto the placing plate 105. In this case, since the bill is conveyed to the appropriate pressing position without leaning to either side by the pair of belts 150 as described above, even if the presser plate 115 is moved, the bill is placed on the placing plate 105 stably without jamming or the like between the presser plate 115 and the pair of regulatory members 110.

When the presser plate 115 is moved to the pressing position, the presser plate 115 is processed to wait (ST131) for a predetermined time (200 ms) at the pressing position so as to place the bill stably on the placing plate 105, and thereafter, the driving motor 20 of the presser plate 115 is driven to rotate reversely (ST132). Then, when it is detected by the presser plate detecting sensor 23 that the presser plate 115 has moved from the pressing position to the aforementioned standby position, the driving of the motor 20 is stopped, and the presser plate 115 is stopped in the standby position (ST133: Yes, ST134). As described above, the bill cannot be drawn out in this standby position.

In addition, if the presser plate detecting sensor 23 does not detect that the presser plate 115 has moved from the pressing position to the standby position within a predetermined period of time, it is considered that something is wrong with the stack operation, and the signal expressing that something is wrong with the stack operation (an error signal) is transmitted to an external apparatus, annunciation means, or the like (ST133; No, ST133A).

Then, after the presser plate 115 is moved from the pressing position to the standby position, in a case where the magnetic sensor 140 detects magnetism provided to the rear surface of the placing plate 105 (ST135; Yes), a detection signal is sent to the CPU 210 to inform that the number of bills stacked in the bill housing part 100 approaches the predetermined number (ST136: No, ST137).

In this embodiment, in designing a detection signal generation as a threshold value from the magnetic sensor 140, the magnetic sensor 140 is installed to generate the detection signal before the number of bills stacked on the placing plate 105 reaches the predetermined number (that is, the predetermined number less nine (9)) in consideration of safely and easy handling.

Concretely, when the magnetic sensor 140 begins to detect the magnetism emitted by the magnet 140*a*, the CPU 210 increments a count repeatedly at each subsequent bill housing operation (for each operation of housing a single bill) (ST138) and writes the information in the RAM 214. When the count is not exceeding nine (9), the CPU 210 causes a notification that the stacker is approaching a full state (ST137). This notification may specifically be comprised of a drive signal to be sent to the notification means 250 (see FIG. 15) configured with a speaker that notifies such a state by sound, a lamp that notifies the state visually, and so on, as mentioned above, to make the administrator and the like notified that the stacker is approaching a full state by means of the sound, lamp, and so on. With this notification, the administrator can exchange the bill housing parts 100 before the number of bills in the bill housing part 100 reaches the predetermined number.

Otherwise, the CPU 210 may be configured to send an error signal to the management apparatus or another external apparatus 270 that manages the operations of bill processing apparatuses (see FIG. 15) to enable the state to be grasped in the other location. By this configuration, the timing for removing the bill housing part 100 can be managed appropriately.

Further, after the magnetic sensor 140 detects the magnetism, when it is detected that ten (10) or more times the bill stack operation is repeated without exchanging the bill housing part 100 (ST136; Yes), a process of disabling the apparatus is executed in order for bills not to be further inserted therein (ST136A). With respect to this disabling process, for example, a process of stopping the bill conveyor motor 13 driving the bill conveyance mechanism 6 described above may be performed in order not to convey the bill inside even if a user inserts a bill into the bill insertion slot. In this way, because no more bills beyond the predetermined number of bills are thus prevented from being conveyed into the bill housing part 100, it is possible to prevent components of the bill housing part 100 from breaking down.

Also, in the process of ST21 as described above, when the inserted bill is judged as a non-legitimate bill or the operator presses the return button (ST23; No), a traveling route opening process is executed (ST51, refer to ST100 to ST102 of FIG. 19), then, the bill conveyor motor 13 is driven to rotate reversely, and the conveyor roller pair (14A, 14B) are brought into contact with each other such that the bill waiting at the escrow position is conveyed toward the bill insertion slot 5 (ST52 and ST53). Then, when the insertion detecting sensor 7 senses the trailing end of the bill to be returned toward the bill insertion slot 5, the driving to reversely rotate the bill conveyor motor 13 is stopped, and above-described driving source 70 is driven to make the conveyor roller pair (14A and 14B) having been in a state of nipping and holding the bill therebetween separate from each other (ST54 to ST56). Then, the traveling route closing process is executed (AT57), the motor 20 for driving the presser plate 115 is driven to rotate forward for a predetermined amount to return the presser plate, which had been moved to the initial position in ST02, to the standby position (ST58), and the series of processes have been completed.

In the bill processing apparatus having the above-mentioned configuration, as bills are stacked and housed on the placing plate 105 inside the bill housing part 100, the position of the placing plate 105 moves gradually, and the magnetic sensor 140 starts to detect the magnetic field of the magnet 140A installed on the placing plate 105. When the magnetic sensor 140 detects the magnetic field (if the threshold value is exceeded), the CPU 210 of the control means becomes capable of determining whether or not the number of bills inside the bill housing part 100 has reached the predetermined number (whether or not the sate of the bill housing part gets close to full). Therefore, the number of mechanically operating parts can thus be decreased such that it is possible to detect whether the bill housing part is full with stacked bills or not at a lower cost.

As mentioned above, the embodiment of the present invention is described. However, the present invention is not limited to the above-described embodiment, and various modifications of the present invention can be implemented.

For example, in ST136 of the flowchart as shown in FIG. 22, the process of ST136A may be executed when the magnetic sensor 140 detects the magnetism successively for N times. This is because the count number to be measured has also deviations since originally thicker thickness of the damaged bill may be reduced to that of one undamaged bill because of compression force caused by the biasing force of the above-mentioned biasing means 106 after the bill is stacked and housed on the placing plate 105 while the magnetic sensor 140 may detect the magnetism in error since the inserted bill may be damaged severely (wrinkled, twisted, etc.) and one damaged bill may show a thickness more than one piece of undamaged bill at the beginning.

As described above, with respected to the detection signal transmitted from the magnetic sensor 140, it may be made that the detection signal to be transmitted from the magnetic sensor 140 is generated only if the counter consecutively receives the detection signal N times (for example, ten (10) times) such that the above-mentioned error may be prevented.

Further, in the present invention, it suffices that the apparatus is configured to have the magnetic sensor capable of detecting that the number of bills housed in the bill housing part has reached the predetermined number of bills having been determined in advance or has got close to the predetermined number, and other configurations of the apparatus, such as driving sources driving the various driving members or power transmission mechanisms from the driving sources, are appropriately modified.

In the above-described embodiment, the position of the placing plate inside the paper sheet housing part moves gradually as more and more paper sheets get stacked and housed on the placing plate. The magnetized magnetic body is disposed on the placing plate and the magnetism from the magnetic body is detected by the magnetic sensor according to the movement of the placing plate. In the process of detecting the magnetism amount from the magnetic body disposed on the placing plate, by setting a predetermined threshold value concerning the detected magnetism amount to be determined by the determination means, it becomes possible to determine whether or not the paper sheet housing part has become full with paper sheets. Therefore, the number of mechanically operating components can thereby be reduced and the full state of the paper sheet housing part with paper sheets can be detected at a low cost.

Further, a shield body which shields the magnetic sensor from magnetism is arranged along a direction of movement of the placing plate between the magnetic sensor and the magnetic body, and as the magnetic body moves with respect to the shield body in accordance with the movement of the placing plate, the threshold value can be set when the placing plate is moved to a position where an amount of magnetism from the magnetic body can be detected by the magnetic sensor.

In such a configuration, by installing the shield body, it is possible to set the magnetism detection position with respect to the magnetic sensor precisely and it is possible to detect the position of the placing plate and specifically to accurately detect that the number of paper sheets placed on the placing plate becomes a predetermined set value.

Further, when the determination means determines that the amount of magnetism is at least the threshold value, the apparatus may comprise notification means to notify what is detected.

In such a configuration, the paper sheets are filled in and such a state is notified so that it is possible to find earlier that the paper sheet housing part is in a full state with paper sheets. In such a case, by way of example, the notification means may notify it in voice or visually such as by blinking light.

Also, the paper sheet processing apparatus comprises: a conveyor mechanism which conveys a paper sheet to a paper sheet housing part; and control means which controls conveyor processing of the paper sheet by the conveyor mechanism, wherein the control means is capable of disabling the conveyor processing of the paper sheet when the determination means determines that the amount of magnetism is at least the threshold value.

In such a configuration, because when full state of the paper sheet is reached, the control means disables the paper sheet conveyance process operation, the conveyor processing of paper sheets to the paper sheet housing part is prevented beyond a limit. Malfunction of components of the paper sheet housing part can thereby be prevented.

Further, notification means can transmit an error signal to an external apparatus that manages operations of the paper sheet processing apparatus when the determination means determines an amount of magnetism is greater than or equal to a threshold value.

In such a configuration, for example, the management device (external apparatus) that manages the paper sheet processing device can take care of processing when the apparatus is full with paper sheets such that it is possible to remove the paper sheet housing part at an appropriate timing.

As described above, the paper sheet processing apparatus which is capable of inexpensively detecting that the paper sheet housing part becomes full with paper sheets can be provided.

The present invention can be incorporated into various types of apparatuses to provide products and services by inserting a bill thereinto, for example. It is also possible to apply it to a processing device to process a paper sheet such as a coupon ticket, not limited to, but including the bill.

What is claimed is:

1. A sheet processing apparatus comprising:

a detachable sheet housing part in which a sheet is stacked;

a placing plate which is installed in the detachable sheet housing part and moves as the sheet is stacked and housed therein;

a magnetic body which is magnetized and is disposed on the placing plate;

a magnetic sensor disposed on a stand, which detachably supports the detachable sheet housing part, the magnetic sensor detecting an amount of magnetism from the magnetic body; and a determination unit comprising a central processing unit, which determines whether the amount of magnetism detected by the magnetic sensor is greater than or equal to a threshold value or not; and a shield body disposed on a side of the detachable sheet housing part between the magnetic sensor and the magnetic body and extending along the side in a movement direction of the placing plate, wherein the magnetic body is moved with respect to the shield body as the placing plate moves and the threshold value is set in association with a position at which the magnetic sensor can detect the magnetism.

2. The sheet processing apparatus according to claim 1, further comprising:

a notification unit which notifies that the amount of magnetism is greater than or equal to the threshold value when the determination unit determines the amount of magnetism is greater than or equal to the threshold value.

3. The sheet processing apparatus according to claim 1, comprising:

a conveyance mechanism which conveys a sheet to the detachable sheet housing part; and a control unit which controls conveyor processing of the sheet by the conveyance mechanism, wherein the control unit disables the conveyor processing of the sheet when the determination unit determines that the amount of magnetism is greater than or equal to the threshold value.

4. The sheet processing apparatus according to claim 3, wherein the control unit causes an error signal to be transmitted to an external apparatus that manages an operation of the sheet processing apparatus when the determination unit determines the amount of magnetism is greater than or equal to the threshold value.

5. A sheet processing apparatus comprising:

a detachable sheet housing part in which a sheet is stacked and housed;

a placing plate which is arranged in the detachable sheet housing part and moves as a number of sheets stacked and housed is increased;

a magnetic body which is magnetized and disposed on the placing plate; and a magnetic sensor disposed on a stand, which detachably supports the detachable sheet housing part, the magnetic sensor detecting magnetism from the magnetic body as the placing plate is moved to a predetermined position, a determining unit comprising a central processor, which determines whether the amount of magnetism detected by the magnetic sensor is greater than or equal to a threshold value or not and which performs a predetermined processing based on the magnetism detected by the magnetic sensor;

a shield body disposed on a side of the detachable sheet housing part between the magnetic sensor and the magnetic body and extending along the side in a movement direction of the placing plate such that the magnetic sensor and the magnetic body do not directly face each other until the placing plate moves to the predetermined position, wherein the magnetic body is moved with respect to the shield body as the placing plate moves and the threshold value is set in association with a position at which the magnetic sensor can detect the magnetism.

6. The sheet processing apparatus according to claim 5, wherein the predetermined processing comprises notifying that magnetism in an amount greater than or equal to the threshold value has been detected.

7. The sheet processing apparatus according to claim 6, wherein the predetermined processing comprises transmitting an error signal to an external apparatus that manages an operation of the sheet processing apparatus.

8. The sheet processing apparatus according to claim 5, comprising:

a conveyance mechanism which conveys a sheet to the detachable sheet housing part; and a control device which controls the conveyance mechanism, wherein the predetermined processing comprises disabling processing of the sheet processing apparatus.

* * * * *